US007380894B2

(12) United States Patent
Berger

(10) Patent No.: US 7,380,894 B2
(45) **Date of Patent: *Jun. 3, 2008**

(54) EXPANDABLE DRAWER ORGANIZER

(76) Inventor: Andrew L. Berger, Axis International Marketing, Inc., 1800 S. Wolf Rd., Des Plaines, IL (US) 60018

( * ) Notice: Subject to any disclaimer, the term of this patent is extended or adjusted under 35 U.S.C. 154(b) by 0 days.

This patent is subject to a terminal disclaimer.

(21) Appl. No.: 11/081,572

(22) Filed: Mar. 16, 2005

(65) Prior Publication Data

US 2005/0162050 A1 Jul. 28, 2005

Related U.S. Application Data

(63) Continuation-in-part of application No. 10/957,404, filed on Oct. 4, 2004, now abandoned.

(51) Int. Cl.
*A47B 88/00* (2006.01)

(52) U.S. Cl. ..... 312/348.3; 312/301

(58) Field of Classification Search ..... 220/551, 220/559, 529, 544, 534, 8, 485, 486, 491, 220/492; 312/348.3, 348.2, 205, 291, 301; D6/491, 510, 511; 211/184; 108/60, 61
See application file for complete search history.

(56) References Cited

U.S. PATENT DOCUMENTS

| | | | | | |
|---|---|---|---|---|---|
| 381,143 | A * | 4/1888 | Kimball | 206/369 |
| 958,857 | A * | 5/1910 | Dennis | 220/8 |
| 2,257,536 | A * | 9/1941 | Roycroft | 211/126.1 |
| 3,003,840 | A * | 10/1961 | Katzin | 312/298 |
| 3,463,343 | A * | 8/1969 | Asenbauer | 220/8 |
| 3,632,013 | A * | 1/1972 | Rothenberg et al. | 220/540 |
| 4,305,629 | A | 12/1981 | Friis | |
| 4,676,384 | A * | 6/1987 | Schafer | 211/184 |
| 4,909,406 | A * | 3/1990 | Wu | 220/8 |
| 4,982,857 | A * | 1/1991 | Sher | 220/4.03 |
| 4,993,786 | A * | 2/1991 | De Giulio | 312/298 |
| 5,016,772 | A * | 5/1991 | Wilk | 220/8 |
| 5,031,769 | A * | 7/1991 | Shea et al. | 206/335 |
| 5,139,186 | A * | 8/1992 | Loew et al. | 224/42.39 |
| 5,257,693 | A | 11/1993 | Kwasniak | |
| 5,385,230 | A | 1/1995 | Nygard | |
| 5,607,213 | A | 3/1997 | Slivon | |
| 5,738,425 | A * | 4/1998 | Rosenberg et al. | 312/348.3 |
| 6,082,537 | A | 7/2000 | Quinn | |
| 6,467,622 | B1 * | 10/2002 | Hull | 206/553 |
| 6,886,693 | B1 * | 5/2005 | Davenport et al. | 206/494 |
| 6,991,307 | B2 * | 1/2006 | Hoenig | 312/348.3 |

(Continued)

*Primary Examiner*—Janet M. Wilkens
(74) *Attorney, Agent, or Firm*—Cardinal Law Group

(57) ABSTRACT

Embodiments of an expandable drawer organizer for segregating articles within a drawer are disclosed. Each embodiment utilizes at least one tray maintained in slidable agreement with another a tray, providing for the expandable drawer organizer to be varied to approximate the dimensional constraints of the subject drawer. Each embodiment further employs a locking mechanism for securing the associated trays in a user dictated predetermined position. Additional embodiments utilizing various arrangements of an expandable partition that may be arranged in unique configurations within the various trays is also disclosed. Several embodiments having retainers for further limiting the movement of the expandable drawer organizer within the drawer are also presented. Several embodiments are also disclosed and claimed that seek to more exactly retain various utensils i.e. cutlery, in one such embodiment additional storage is provided in a hidden compartment.

1 Claim, 15 Drawing Sheets

U.S. PATENT DOCUMENTS

2004/0004420 A1* 1/2004 Pine et al. ..... 312/348.3
2004/0245254 A1* 12/2004 Rosenberg et al. ..... 220/507
2007/0159040 A1* 7/2007 Fernandez et al. ..... 312/348.3

* cited by examiner

EXPANDABLE DRAWER ORGANIZER

CROSS REFERENCE TO RELATED APPLICATIONS

This continuation-in-part application claims the benefit of U.S. Non-Provisional application Ser. No. 10/957,404 now abandoned, Expandable Drawer Organizer, filed 4 Oct. 2004 presently co-pending, which claims the benefit of U.S. Non-Provisional application Ser. No. 10/641,482, Expandable Drawer Organizer, filed 16 Aug. 2003 presently co-pending, which claims the benefit of U.S. Provisional Application No. 60/446,196, Expandable Drawer Organizer, filed 10 Feb. 2003 presently abandoned in accordance with 35 USC § 119 (e); and U.S. Design Application No. 29/200,991, Expandable Knife Holder and Storage Unit, filed 8 Mar. 2004 presently co-pending, in accordance with 35 USC §120; the disclosures of which are hereby incorporated by reference herein.

BACKGROUND OF THE INVENTION

1. Field of the Invention

The present invention specifically relates to an expandable drawer organizer for accommodating drawers of various sizes and a method for the organization of various articles within a drawer.

2. Description of the Related Art

The efficient organization of various articles within a drawer, whether they are tools, cutlery, hardware, toiletries or other sundry items, has long presented a problem for the users of such items. One such attempt to address the problem has been by the use of boxes positioned within the drawer. However, an inherent shortcoming of this approach is the need to arrange individual boxes into a specific arrangement tailored exclusively to the drawer or other like drawers having the same dimensional configuration. Another drawback is that the boxes may not effectively utilize the drawer area, resulting in an underutilization of the drawer storage capacity, due to the ill fit of the boxes. The use of boxes also raises a durability concern for the user, especially when heavy, bulky or sharp items are concerned which, require that the user frequently replace, repair or discard the damaged boxes. Yet, another issue that this approach fails to address is that of portability; as the boxes are limited to the present configuration within drawers having similar dimensional constraints thereby creating further issues of underutilization based on the drawer area and individual box dimensions. Even if this particular limitation can be overcome, the user is subsequently presented with the time consuming and burdensome task of disassembly and reassembly of the configuration within the new location. It would be advantageous to have an organizer that overcomes the issues presented by this approach.

Another approach is the use of separators, which span either the width, or length of a drawer, which may be of either non-adjustable permanent-type, adjustable permanent-type or temporary construction. These each suffer the inherent difficulty of being specific to the drawer where they are employed and typically lack interchangeability among drawers having different dimensional configurations, this point is most pronounced with the permanently affixed and adjustable permanent-type separators. Often, these approaches require that the drawer be customized to accommodate the separators and prevent the movement or collapse of the separator when the drawer is opened or closed, especially when containing heavy articles, i.e. tools, hardware, dishes, etc. This solution in the case of adjustable permanent-type and temporary separators, like the use of the boxes before, require the user to carefully configure the arrangement of the separators to form spaces that are specific to the article(s) in question, in order to assure optimum utilization of the drawer area. In the case of the non-adjustable permanent-type separators, the user must given careful consideration to the materials to be organized in the drawer, as future modifications imposes the need to remanufacture the drawer to accommodate the new arrangement. Both non-adjustable and adjustable permanent-type separators force the user to incur the increased cost of custom drawers and related components necessary to facilitate the use these separators. In attempts to address the issue of cost concerns native to the non-adjustable and adjustable permanent-type separators; temporary separators have been introduced which, are constructed of less durable materials that often lack the structural integrity required to retain heavy articles without the separator sustaining damage. The user of such temporary separators is often faced with the repeated replacement of the separator over the lifetime of the drawer. Lastly, the use of both permanent-type and temporary separators present an impediment to cleaning the drawer base, as the individual articles must be removed to allow for cleaning the interior drawer surfaces. A device for organization of articles within a drawer that addresses the failings of this approach would be most desirable.

In an endeavor to surmount the inadequacies posed by the previous attempts to compartmentalize drawers by use of either boxes or separators, the use of expanding trays as typified by U.S. Pat. No. 5,738,425, Adjustable Drawer Organizer has been developed. Although, this device appears to remedy the aforementioned list of deficiencies presented by its precursors, there are a number of distinct new limitations that are imposed upon the user. The first being, that the configuration of these trays is fixed and inflexible, as the tray compartments cannot be rearranged to suit an individual user preference. This issue is further compounded when the expandable organizer is expanded, in such an instance the user is presented with one tray section comprising permanently affixed separators, which establish rigid constraints regarding the compartmentalization of the section, and at least one open tray section wholly devoid of any partition for optimizing the arrangement of articles in the section. This problem requires that boxes must be employed in concert with the expandable organizer to achieve an acceptable means of segregating articles within the open section(s) of the organizer. Attempts to utilize separators in the open section(s) of the organizer fail to generate configurations other than elongated compartments, which may vary from narrow to broad in width. Further efforts to customize the compartments require the user to fashion components specific to the compartment width and secure these to the tray section or separator. The resulting arrangement is a regression to the permanent-type separator approach that is specific for the drawer in question. Another significant issue regarding the drawer organizer is retaining the position of the organizer within a drawer, given a drawer of length greater than the organizer and articles of notable mass. The typical approach has been to affix feet constructed of non-slip material to the bottom of the organizer, and to rely upon gravity and friction to secure the position of the organizer within the drawer. However, when the organizer contains articles of notable mass and the drawer is opened with sufficient force, so as to impart momentum to its contents, the organizer may be slammed to the rear of the drawer and the contents may be disrupted. A device for organization of articles within a drawer that could eliminate these concerns would be of great advantage to a user.

It would be most desirable to a user to have an organizer, which overcomes the collective disadvantages posed by each of the above approaches in the storage of articles in a drawer.

SUMMARY OF THE INVENTION

The present invention, an expandable drawer organizer relates to an apparatus for segregating articles within drawers, having differing dimensional parameters. Various aspects of the invention are novel, non-obvious, and provide various advantages. While the actual nature of the present invention covered herein can only be determined with reference to the claims appended hereto, certain features, which are characteristic of the embodiments disclosed herein, are described briefly as follows.

A first aspect of the invention provides an expandable drawer tray for segregating articles in a drawer, wherein a base tray having at least one recess in one of either the front and rear side panel is slidably connected to a first nesting tray having a corresponding protuberance in one of either the front and rear side panel; wherein the base tray and first nesting tray are expanded to a predetermined length in a drawer and maintained in relative position by an locking mechanism. In a further embodiment, the assembled base tray and first nesting tray further comprising a ledge on opposing first (widthwise) side panels of the base tray and first nesting tray, which are substantially parallel to the top plane of a selected drawer. In another embodiment, the underside of the ledges that are in direct contact with the drawer may have inserts comprised of an anti-friction material, i.e. TEFLON®, melamine, plastic, polished marble, felt or other similar surface that will afford the expandable drawer organizer to glide upon the topmost edges of the drawer. In another embodiment, at least one roller may be located in the ledge so as to permit the drawer organizer to roll on the topmost edge of the drawer without damaging the drawer. This aspect is largely repeated in another embodiment of the invention having a base tray, first and second nesting tray, slidably connected with a similar locking mechanism for securing the trays at a predetermined length within a drawer. This aspect permits a user to optimize the use of the drawer space constraints without being limited to a set drawer dimensions, thus providing for interchangeability of the expandable drawer organizer and overcoming the previously mentioned portability limitations. In another embodiment the base tray may comprise a at least one angled row configured so as to provide for a unique storage arrangement for spices, medicines, hardware or other individually packaged items stored in small containers. In a further embodiment, the angled row may also have at least one position about its length of a given size and shape to accommodate a corresponding container. In a further embodiment, the angled row may be hollow and may further comprise at least one hidden storage compartment, whereby the user may place additional items. In another embodiment, either or both of the first and second nesting trays may comprise an angled row configured so as to provide for a unique storage arrangement for spices, medicines, hardware or other individually packaged items stored in small containers and may further comprise a hollow structure wherein at least one hidden storage compartment may be located, whereby the user may place additional items. In another embodiment, the base or first nesting tray may have at least one angled slot located in correspondence in the inside front and rear panels, or the inside first side panel walls, whereby a user may insert a row insert into the slot to form a row. In another embodiment, the base or first nesting tray may have at least one recess in correspondence, in the inside front and rear panels, or the inside first panel walls; that may receive a row insert having a corresponding protuberance located in a first and second end. In another embodiment at least one detachable cleat may be located at a predetermined position within the bottom panel that may secure the bottommost edge of the row insert. In a further embodiment the row insert may have at least one peg located about the bottommost edge that may be received in a corresponding hole in the bottom panel of the base tray or first nesting tray.

A second aspect of the invention provides for a detachably connected expandable partition that is tensionably extended to a predetermined length and therein secured in an angled or normal position to opposing panel walls by a locking mechanism comprising spring-loaded protuberances that are received in corresponding recesses, wherein the expandable partition may be arranged in a number of unique user defined arrangements. This aspect directly overcomes the previous need for a customized drawer tray configuration, while simultaneously maintaining the desired interchangeability of the organizer between drawers of differing dimensional constraints. In another embodiment, the expandable partition may comprise a variety of shapes to accommodate specific containers and accommodate individually packaged items to permit optimization of their storage. In a variant of this embodiment the partition may comprise a panel of a given length having a plurality of slots or recesses to receive a slotted non-expandable divider of a given length and configuration or another expandable divider oriented such that slotted elements are in agreement which may normally engage adjacent partitions, panels or the sides of the drawer directly.

DETAILED DESCRIPTION OF THE PRESENTLY PREFERRED EMBODIMENTS

FIGS. 1-22 illustrate various embodiments of an expandable drawer organizer in accordance with the present invention.

Figure 1:
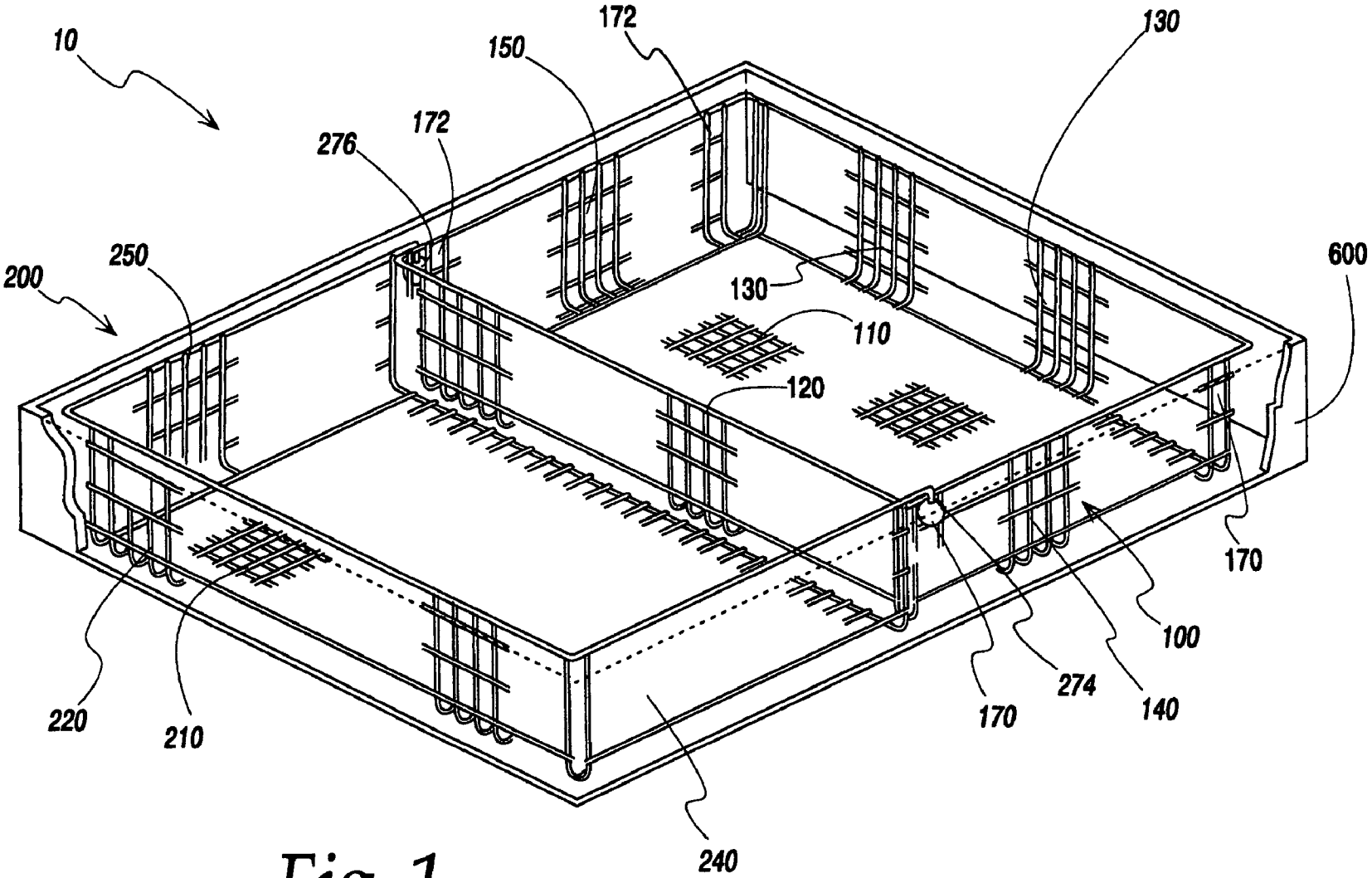
FIG. 1 is a drawing showing a perspective view of an assembled two tray expandable drawer organizer, having a base tray and a first nesting tray, in accordance with the present invention.

Referring to FIG. 1 one embodiment of a two tray expandable drawer organizer is generally shown at number 10. The expandable drawer organizer 10 of the present invention generally comprises a base tray 100 and a first nesting tray 200. The base tray 100 may have a given length and width to allow it to be slidably received by the first nesting tray 200. This arrangement serves to permit the expandable drawer organizer 10 to accommodate drawers of varying dimensional characteristics permitting a user to optimize the utilization of drawer space without compromising flexibility. The base tray 100 and a first nesting tray 200 may be set at a predetermined length wherein a locking mechanism 50 (FIG. 4-6) comprised of an engagement of the front panel protuberance 274 (FIG. 6) and rear panel protuberance 276 (FIG. 6) with the corresponding front panel recess in 170 (FIG. 6) and rear panel recess 172 (FIG. 6) is generally formed, which may serve to secure the expandable drawer tray 10 position within the drawer 600.

Figure 2:
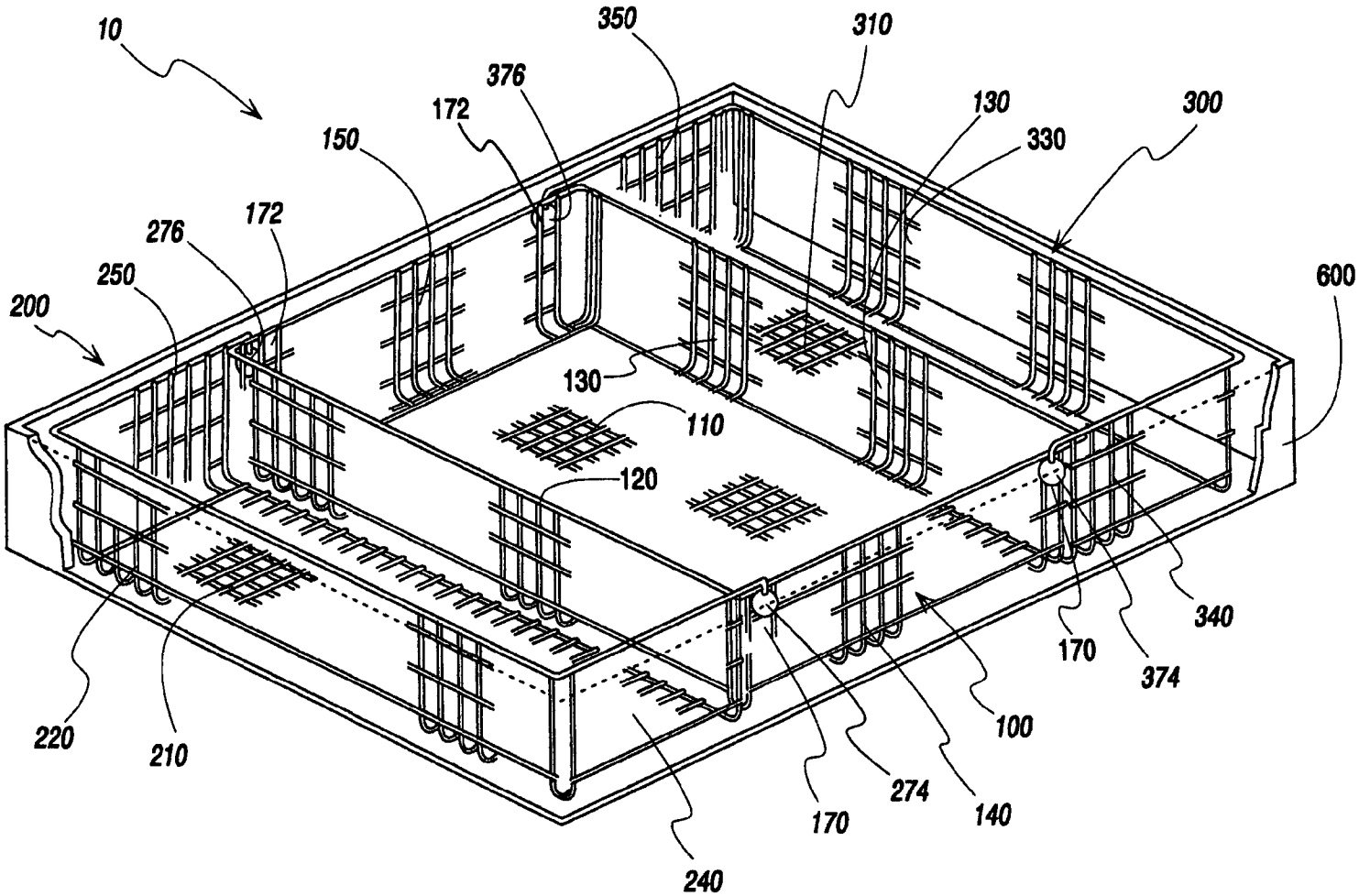
FIG. 2 is a drawing showing a perspective view of an assembled three tray expandable drawer organizer, having a base tray, a first nesting tray and a second nesting tray, in accordance with the present invention.
Figure 3:
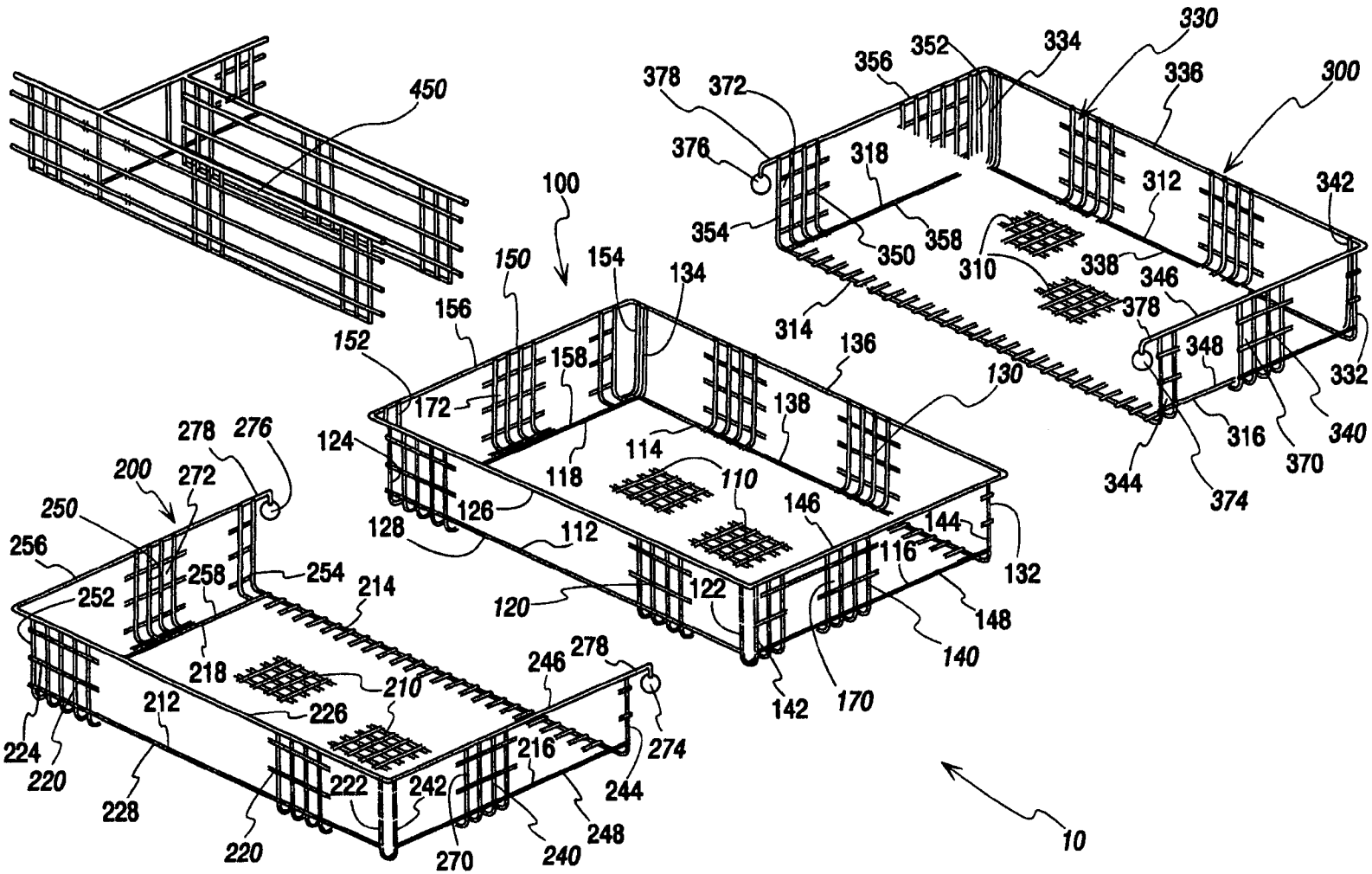
FIG. 3 is a drawing showing a perspective view of an unassembled three tray expandable drawer organizer, having a base tray, a first nesting tray and a second nesting tray, in accordance with the present invention.

Referring to FIGS. 2 and 3 one embodiment of a three tray expandable drawer organizer of the present invention is generally shown at number 10. The expandable drawer organizer 10 of the present invention generally comprises a base tray 100, a first nesting tray 200 and a second nesting tray 300. The base tray 100 may have a given length and width to allow it to be slidably received by both the first nesting tray 200 and second nesting tray 300. This arrangement serves to permit the expandable drawer organizer 10 to accommodate drawers of varying dimensional characteristics permitting a user to optimize the utilization of drawer space without compromising flexibility. The base tray 100, first nesting tray 200 and second nesting tray 300 may be set at a predetermined length wherein a locking mechanism 50 (FIG. 4-6) comprised of an engagement of the front panel protuberance 274 (FIG. 6) and rear panel protuberance 276 (FIG. 6) with the corresponding front panel recess in 170 (FIG. 6) and rear panel recess 172 (FIG. 6) is generally formed, a similar arrangement is generally reflected at each of the second nesting tray 300 front panel protuberance 374 and rear panel protuberance 376 with the corresponding front panel recess in 170 and rear panel recess 172; which may serve to secure the expandable drawer tray 10 position within the drawer 600.

Referring to FIGS. 1, 2 and 3 one embodiment of base tray of the expandable drawer organizer 10 is generally shown at number 100. The base tray 100 may compromise a bottom panel 110 having a rectangular shape of a given length and width, a first side panel 120 having a rectangular shape of a given height and a length corresponding to the bottom panel 110, a second side panel 130 having a rectangular shape of a given height and substantially similar length to the first side panel 120, a front side panel 140 having a rectangular shape of a substantially similar height to each of the first side panel 120 and second side panel 130, and length corresponding to the base tray 100, and rear side panel 150 having a rectangular shape of a given height and substantially similar length to the front side panel 140. The first side panel 120 may be adjoined to the bottom panel 110 in a substantially perpendicular manner, wherein the bottom panel first edge 112 (FIG. 3) and the first side panel bottom edge 128 (FIG. 3) are maintained in continuous agreement over their length. The second side panel 130 may be adjoined to the bottom panel 110 in a substantially perpendicular manner, wherein the bottom panel second edge 114 (FIG. 3) and the second side panel bottom edge 138 (FIG. 3) are maintained in continuous agreement over their length, wherein the second side panel 130 may be in parallel alignment to the first side panel 120. The front side panel 140 may be adjoined to the bottom panel 110 in a substantially perpendicular manner, wherein the bottom panel front panel edge 116 (FIG. 3) and the front side panel bottom edge 148 (FIG. 3) are maintained in continuous agreement over their length. The front side panel 140 may also be adjoined to each of the first side panel 120 and second side panel 130 in a substantially perpendicular manner, wherein the front side panel first edge 142 (FIG. 3) and front panel side second edge 144 (FIG. 3) are maintained in continuous agreement over their length with the respective first side panel front edge 122 (FIG. 3) and second side panel front edge 132 (FIG. 3). The rear side panel 150 may be adjoined to the bottom panel 110 in a substantially perpendicular manner, wherein the bottom panel rear edge 118 (FIG. 3) and the rear side panel bottom edge 158 (FIG. 3) are maintained in continuous agreement over their length. The rear side panel 150 may also be adjoined to each of the first side panel 120 and second side panel 130 in a substantially perpendicular manner, wherein the rear side panel first edge 152 (FIG. 3) and rear side panel second edge 154 (FIG. 3) are maintained in continuous agreement over their length with the respective first side panel rear edge 124 (FIG. 3) and second side panel rear edge 134 (FIG. 3). The rear side panel 150 being in substantially parallel alignment with the front side panel 140. The first side panel top edge 126 (FIG. 3), second side panel top edge 136 (FIG. 3), front side panel top edge 146 (FIG. 3) and rear side panel top edge 156 (FIG. 3) may exhibit congruency within a common plane. The base tray 100 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The base tray 100 may also be manufactured by such techniques as extrusion, cold forming methods i.e., bending, braking, shearing, cutting or hot forming methods i.e., casting or extrusion or combinations thereof that may yield similar construction. The front side panel 140 and rear side panel 150 of the base tray 100 of the present invention may respectively have at least one front side panel recess 170 (FIG. 3) and rear side panel recess 172 (FIG. 3), that may be arranged in a row in the face of each panel being of a given shape and depth to accommodate the respective first nesting tray 200 front side panel protuberance 274 (FIG. 3) and rear side panel protuberance 276 (FIG. 3) and in the case of the three tray expandable organizer 10 to accommodate the respective second nesting tray 300 front side panel protuberance 374 (FIG. 3) and rear side panel protuberance 376 (FIG. 3). In another embodiment of the base tray 100, the front side panel 140 and rear side panel 150 may respectively have at least one front side panel protuberance and rear side panel protuberance, that may be arranged in a row on the face of each panel being of a given shape and depth to accommodate the respective first nesting tray 200 and second nesting tray 300 front side panel recesses and rear side panel recesses. The base tray 100 may also have partitions 450 (FIG. 3) adjoined in normal position to the bottom panel 110 and at least one side of the base tray 100 to form compartments of a rectangular nature. In another embodiment, the expandable partitions 500 (FIG. 7) and fixed length partitions may be employed which may utilize a locking mechanism based upon the arrangement of protuberances and recesses similar to the arrangement utilized to secure the base tray 100, first nesting tray 200 and second nesting tray 300 at a predetermined length.

Figure 4:
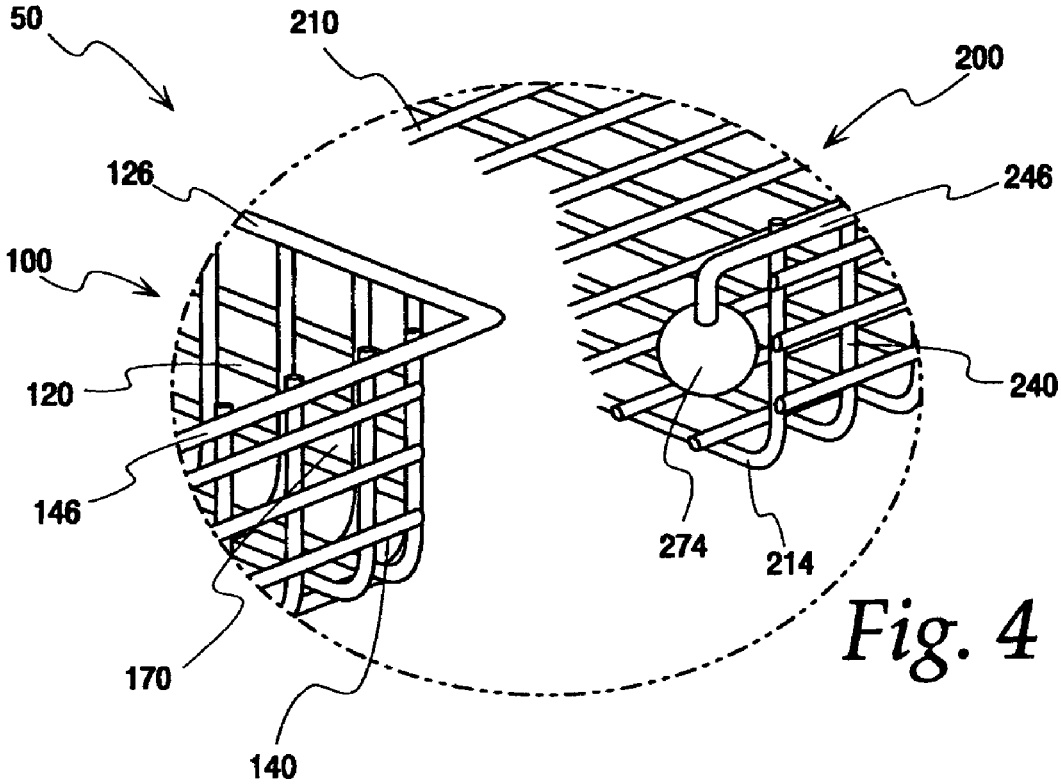
FIG. 4 is a drawing showing a detail in perspective view of the locking mechanism of the base tray and first nesting tray of the expandable drawer organizer prior to engagement, in accordance with the present invention.
Figure 5:
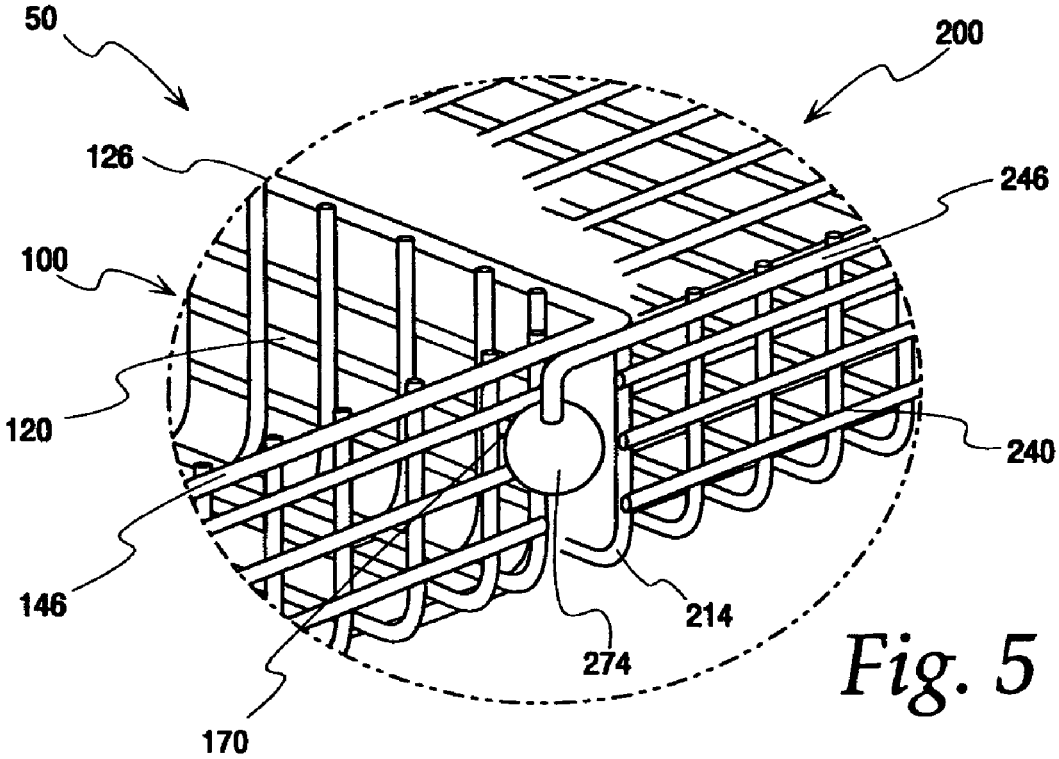
FIG. 5 is a drawing showing a detail in perspective view of the locking mechanism of the base tray and first nesting tray of the expandable drawer organizer after engagement, in accordance with the present invention.
Figure 6:
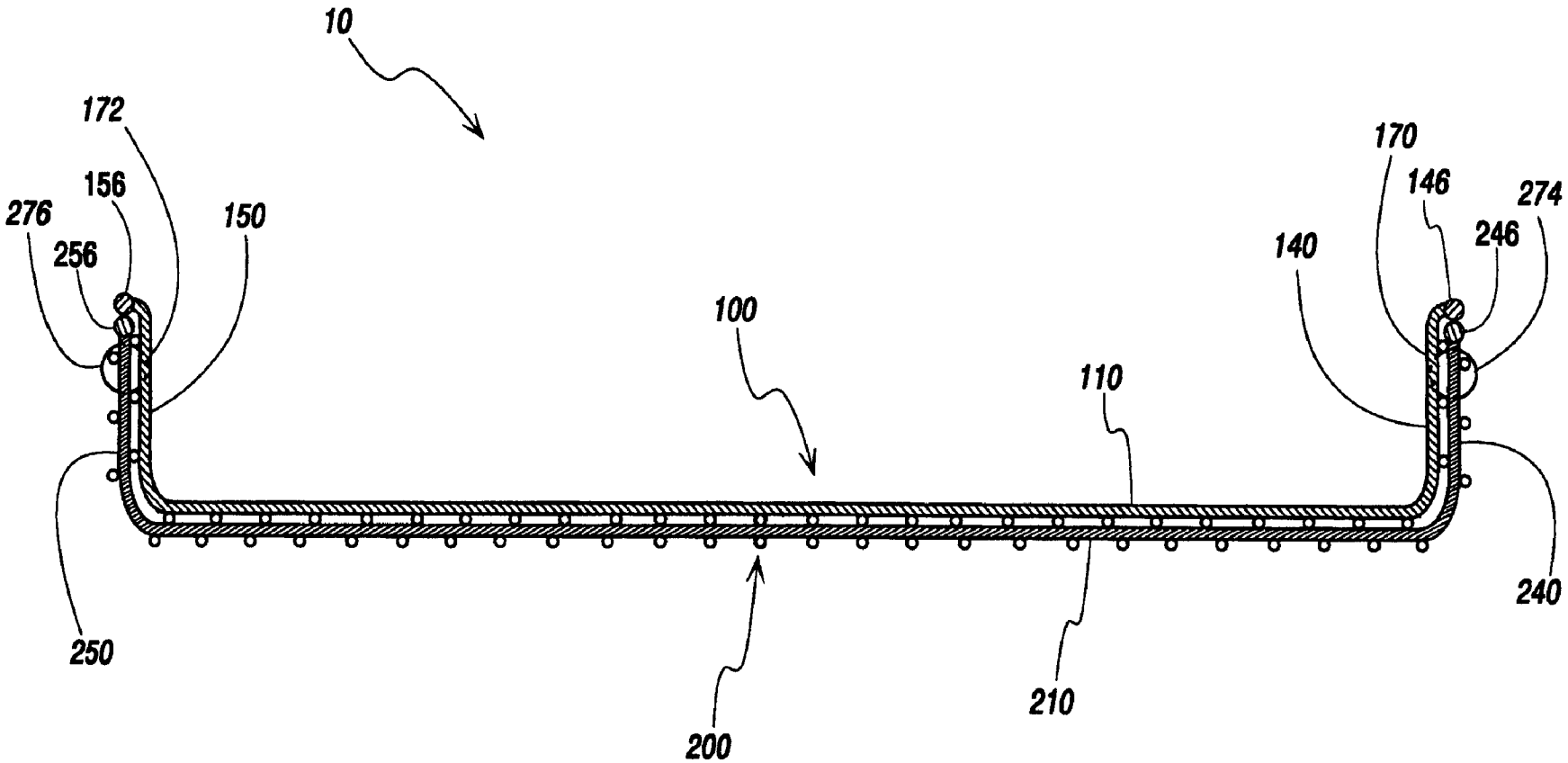
FIG. 6 is a drawing showing a side view of an assembled two tray expandable drawer organizer, showing the base tray and first nesting tray secured by a locking mechanism in accordance with the present invention.

Referring to FIGS. 1, 2 and 3 one embodiment of the first nesting tray is generally shown at number 200. The first nesting tray 200 may compromise a bottom panel 210 having a rectangular shape of a given length and width, a first side panel 220 having a rectangular shape of a given height and a length corresponding to the bottom panel 210, a front side panel 240 having a rectangular shape of a substantially similar height to the first side panel 220, and length corresponding to the first nesting tray 200, and rear side panel 250 having a rectangular shape of a given height and substantially similar length to the front side panel 240. The first side panel 220 may be adjoined to the bottom panel 210 in a substantially perpendicular manner, wherein the bottom panel first edge 212 (FIG. 3) and the first side panel bottom edge 228 (FIG. 3) are maintained in continuous agreement over their length. The front side panel 240 may be adjoined to the bottom panel 210 in a substantially perpendicular manner, wherein the bottom panel front edge 216 (FIG. 3) and the front side panel bottom edge 248 (FIG. 3) are maintained in continuous agreement over their length. The front side panel 240 may also be adjoined to the first side panel 220 in a substantially perpendicular manner, wherein the front side panel first edge 242 (FIG. 3) and the respective first side panel front edge 222 (FIG. 3) are maintained in continuous agreement over their length. The rear side panel 250 may be adjoined to the bottom panel 210 in a substantially perpendicular manner, wherein the bottom panel rear edge 218 (FIG. 3) and the rear side panel bottom edge 258 (FIG. 3) are maintained in continuous agreement over their length. The rear side panel 250 may also be adjoined to the first side panel 220 in a substantially perpendicular manner, wherein the rear side panel first edge 252 (FIG. 3) and respective first side panel rear edge 224 (FIG. 3) are maintained in continuous agreement over their length. The rear side panel 250 being in substantially parallel alignment with the front side panel 240. The first side panel top edge 226 (FIG. 3), front side panel top edge 246 (FIG. 3) and rear side panel top edge 256 (FIG. 3) may exhibit congruency within a common plane. The bottom panel second edge 214 (FIG. 3) is adjoined to the front side panel second edge 244 (FIG. 3) and rear side panel second edge 254 (FIG. 3) in a substantially perpendicular manner to form an opening to receive the base tray 100. The first nesting tray 200 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The first nesting tray 200 may also be manufactured by such techniques as extrusion, cold forming methods i.e., bending, braking, shearing, cutting or hot forming methods i.e., casting or extrusion or combinations thereof that may yield similar construction. The front side panel 240 and rear side panel 250 of the first nesting tray 200 of the present invention may respectively have at least one front side panel protuberance 274 (FIG. 3) and rear side panel protuberance 276 (FIG. 3), each being attached to a protuberance support 278 (FIG. 3) which extends from the front side panel top edge 246 (FIG. 3) and rear side panel top edge 256 (FIG. 3) respectively. The front side panel protuberance 274 (FIG. 3) and rear side panel protuberance 276 (FIG. 3) each forming a head at the proximal end of the protuberance support 278 (FIG. 3). The protuberance head being of a given solid shape having substantial dimensional compliance to be securely positioned in the respective base tray 100 front panel recess 170 (FIG. 3) and rear panel recess 172 (FIG. 3). In another embodiment of the first nesting tray 200, the front side panel 240 and rear side panel 250 may respectively have at least one front panel protuberance and rear panel protuberance, that may be arranged in a row on the face of each panel being of a given shape and size to accommodate the respective base tray 100 front side panel recess and rear side panel recess. In another embodiment of the first nesting tray 200, the front side panel 240 and rear side panel 250 may respectively have at least one front side panel recess 270 (FIG. 3) and rear side panel recess 272 (FIG. 3), that may be arranged in a row on the face of each panel being of a given shape and depth to accommodate the respective base tray 100 front side panel protuberance and rear side panel protuberance. Subsequently, the expandable drawer organizer 10 may be set at a predetermined length and accordingly maintained by the locking mechanism 50 (FIG. 4-6). In another embodiment the nesting tray 200 may also have expandable partitions 500 (FIG. 7), fixed length partitions or any combination thereof that may be employed which may utilize a locking mechanism based upon the arrangement of protuberances and recesses similar to the arrangement utilized to secure the base tray 100, first nesting tray 200 and second nesting tray 300 at a predetermined length. The expandable partitions 500 (FIG. 7) may be detachably attached in normal position to the bottom panel 210 and at least one side of the first nesting tray 200 to form compartments of a rectangular nature.

Referring to FIGS. 2 and 3 one embodiment of the second nesting tray is generally shown at number 300. The second nesting tray 300 may compromise a bottom panel 310 having a rectangular shape of a given length and width, a first side panel 330 having a rectangular shape of a given height and a length corresponding to the bottom panel 310, a front side panel 340 having a rectangular shape of a substantially similar height to the first side panel 330, and length corresponding to the second nesting tray 300, and rear side panel 350 having a rectangular shape of a given height and substantially similar length to the front side panel 340. The first side panel 330 may be adjoined to the bottom panel 310 in a substantially perpendicular manner, wherein the bottom panel first edge 312 (FIG. 3) and the first side panel bottom edge 338 (FIG. 3) are maintained in continuous agreement over their length. The front side panel 340 may be adjoined to the bottom panel 310 in a substantially perpendicular manner, wherein the bottom panel front edge 316 (FIG. 3) and the front side panel bottom edge 348 (FIG. 3) are maintained in continuous agreement over their length. The front side panel 340 may also be adjoined to the first side panel 330 in a substantially perpendicular manner, wherein the front side panel first edge 342 (FIG. 3) and the respective first side panel front edge 332 (FIG. 3) are maintained in continuous agreement over their length. The rear side panel 350 may be adjoined to the bottom panel 310 in a substantially perpendicular manner, wherein the bottom panel rear edge 318 (FIG. 3) and the rear side panel bottom edge 358 (FIG. 3) are maintained in continuous agreement over their length. The rear side panel 350 may also be adjoined to the first side panel 330 in a substantially perpendicular manner, wherein the rear side panel first edge 352 (FIG. 3) and respective first side panel rear edge 334 (FIG. 3) are maintained in continuous agreement over their length. The rear side panel 350 being in substantially parallel alignment with the front side panel 340. The first side panel top edge 336 (FIG. 3), front side panel top edge 346 (FIG. 3) and rear side panel top edge 356 (FIG. 3) may exhibit congruency within a common plane. The bottom panel second edge 314 (FIG. 3) is adjoined to the front side panel second edge 344 (FIG. 3) and rear side panel second edge 354 (FIG. 3) in a substantially perpendicular manner to form an opening to receive the base tray 100. The second nesting tray 300 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The second nesting tray 300 may also be manufactured by such techniques as extrusion, cold forming methods i.e., bending, braking, shearing, cutting or hot forming methods i.e., casting or extrusion or combinations thereof that may yield similar construction. The front side panel 340 and rear side panel 350 of the second nesting tray 300 of the present invention may respectively have at least one front side panel protuberance 374 (FIG. 3) and rear side panel protuberance 376 (FIG. 3), each being attached to a protuberance support 378 (FIG. 3) which extends from the front side panel top edge 346 (FIG. 3) and rear side panel top edge 356 (FIG. 3) respectively. The front side panel protuberance 374 (FIG. 3) and rear side panel protuberance 376 (FIG. 3) each forming a head at the proximal end of the protuberance support 378 (FIG. 3). The protuberance head being of a given solid shape having substantial dimensional compliance to be securely positioned in the respective base tray 100 front panel recess 170 (FIG. 3) and rear panel recess 172 (FIG. 3). In another embodiment of the second nesting tray 300, the front side panel 340 and rear side panel 350 may respectively have at least one front panel protuberance and rear panel protuberance, that may be arranged in a row on the face of each panel being of a given shape and size to accommodate the respective base tray 100 front side panel recess 170 (FIG. 3) and rear side panel recess 172 (FIG. 3). In another embodiment of the second nesting tray 300, the front side panel 340 and rear side panel 350 may respectively have at least one front side panel recess 370 (FIG. 3) and rear side panel recess 372 (FIG. 3), that may be arranged in a row on the face of each panel being of a given shape and depth to accommodate the respective base tray 100 front side panel protuberance and rear side panel protuberance. Subsequently, the expandable drawer organizer 10 may be set at a predetermined length and accordingly maintained by the locking mechanism 50 (FIG. 4-6). In another embodiment the nesting tray 300 may also have expandable partitions 500 (FIG. 7), fixed length partitions or any combination thereof that may be employed which may utilize a locking mechanism based upon the arrangement of protuberances and recesses similar to the arrangement utilized to secure the base tray 100, first nesting tray 200 and second nesting tray 300 at a predetermined length. The expandable partitions 500 (FIG. 7) may be detachably attached in normal position to the bottom panel 310 and at least one side of the second nesting tray 300 to form compartments of a rectangular nature.

Referring to FIGS. 4, 5 and 6 the present embodiment of a locking mechanism is generally shown at number 50 for a two tray organizer 10. FIGS. 4 and 5 provide an exploded partial view of the locking mechanism 50 respectively in a disengaged and engaged state, wherein the base tray 100 and the first nesting tray 200 are separated, which provide the relative orientation of the base tray 100 first side panel 120 and front side panel 140 with respect to the first nesting tray 200 front side panel 240. The locking mechanism 50 may comprise a base tray 100 having a first set of top rails formed by the front side panel top edge 146 (FIG. 6) and the rear side panel top edge 156 (FIG. 6) that respectively may ride on a first bottom set of rails formed by the front side panel top edge 246 (FIG. 6) and the rear side panel top edge 256 (FIG. 6) of the first nesting tray 200. The first top and bottom set of rails provide a means for slidably conveying the base tray 100 within the first nesting tray 200 while simultaneously providing alignment of the respective trays to permit the engagement of the front side panel protuberance 274 and rear side panel protuberance 276 respectively with the front side panel recess 170 and rear side panel recess 172. In the three tray embodiment of the expandable drawer organizer 10 of the present invention, the locking mechanism 50 may comprise a second bottom rail. The top set of rails formed by the front side panel top edge 146 (FIG. 3) and the rear side panel top edge 156 (FIG. 3) that respectively may ride on a second bottom set of rails formed by the front side panel top edge 346 (FIG. 3) and the rear side panel top edge 356 (FIG. 3) of the second nesting tray 300. The first and second sets of top and bottom rails provide a means for slidably conveying the base tray 100 within the first nesting tray 200 and second nesting tray 300 (FIG. 3) while simultaneously providing alignment of the respective trays to permit the engagement of the front side panel protuberances 274 and 374 rear side panel protuberances 276 and 376 respectively with the front side panel recesses 170 and rear side panel recesses 172.

The locking mechanism 50 of the present embodiment of the two drawer organizer 10 may comprise a protuberance support 278, which extends from the front side panel top edge 246 and rear side panel top edge 256. The three tray drawer organizer 10 may comprise a protuberance support 378 (FIG. 3), which extends from the front side panel top edge 346 (FIG. 3) and rear side panel top edge 356 (FIG. 3) respectively. The protuberance supports 278 and 378 impart a constant force to the attached protuberance(s) as a function of spring tension, which may be accomplished as a function of bending, pre-forming or the attachment of springs to tensionably accomplish this function. The front side panel protuberance 274 and rear side panel protuberance 276 each form a head at the proximal end of the protuberance support 278. The protuberance head being of a given solid shape having substantial dimensional compliance to be securely positioned in the respective base tray 100 front side panel recess 170 and rear side panel recess 172. In another embodiment, the locking mechanism 50 may comprise, the front side panel 240 and rear side panel 250 of the first nesting tray 200 respectively having at least one front side panel protuberance and rear side panel protuberance, that may be arranged in a row on the face of each panel. The front and rear side panel protuberance being of a given shape and size to accommodate the respective front side panel recess and rear side panel recess located in base tray 100 front side panel 140 and rear side panel 150. The protuberance may be attached to a spring and retained in an opening, wherein a given portion of the protuberance may project through the opening to engage a recess.

In another embodiment, the locking mechanism 50 may comprise, the front side panel 240 and rear side panel 250 of first nesting tray 200 respectively having at least one front side panel recess and rear side panel recess, that may be arranged in a row on the face of each panel being of a given shape and depth to accommodate the respective front side panel protuberance and rear side panel protuberance in base tray 100 front side panel 140 and rear side panel 150. The protuberance may be attached to a spring and retained in an opening, wherein a given portion of the protuberance may project through the opening to engage a recess.

Figure 7:
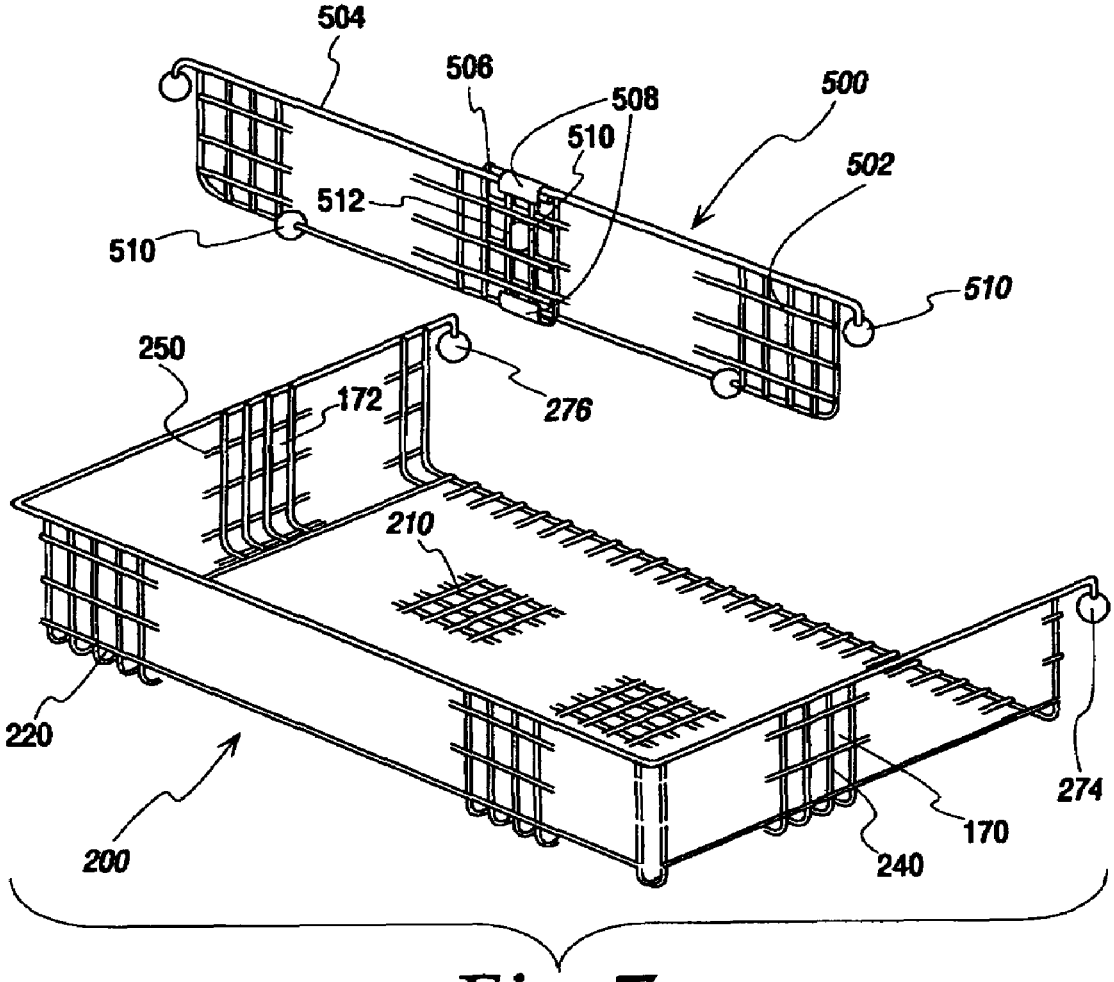
FIG. 7 is a drawing showing a perspective view showing one example of a possible orientation of an adjustable partition and a first nesting tray of the expandable drawer organizer, in accordance with the present invention.

Referring to FIG. 7 the present embodiment of an expandable partition is generally shown at number 500 for an expandable drawer organizer 10. FIG. 7 provides an perspective view of the expandable partition 500 in a disengaged state in respect to the first nesting tray 200 wherein the relative orientation of the expandable partition 500 is substantially parallel to first side panel 220 of the first nesting tray. The expandable partition 500 may be comprised of a first panel 502 and a second panel 504, which may be of similar construction to the first nesting tray 200 (FIG. 3) front side panel 240 (FIG. 3) and rear side panel 250 (FIG. 3); which may be held in slidable communication with at least one panel coupler 508 connected to either of the first panel 502 and second panel 504 top edge, and the first panel 502 and second panel 504 bottom edge. The coupler may comprise any means known in the Mechanical Arts to join panels or similar surfaces when in substantially parallel alignment. The ends of the first panel 502 and second panel 504 edge, and the first panel 502 and second panel 504 bottom edge may have a stop 506, which serves to prevent the accidental separation of the expandable partition 500 by restricting the movement of the panel coupler 508 on the first panel 502 and second panel 504 top edge, and the first panel 502 and second panel 504 bottom edge. The locking mechanism 50 may also be incorporated in the present embodiment of the expandable partition 500 wherein a protuberance 510 located in either of the first panel 502 and second panel 504 engage a corresponding recess 512 in the respective adjoining panel under constant force. Each of the first panel 502 and second panel 504 may also have a protuberance 510 located on the bottom edge, which may engage a corresponding recess in the bottom panel 210. The expandable partition 500 may also incorporate a protuberance 510 attached to projection on the first panel 502 and second panel 504 top edge, that may engage the first nesting tray 200 front panel recess 170 and rear panel recess 172, respectively.

Figure 8:
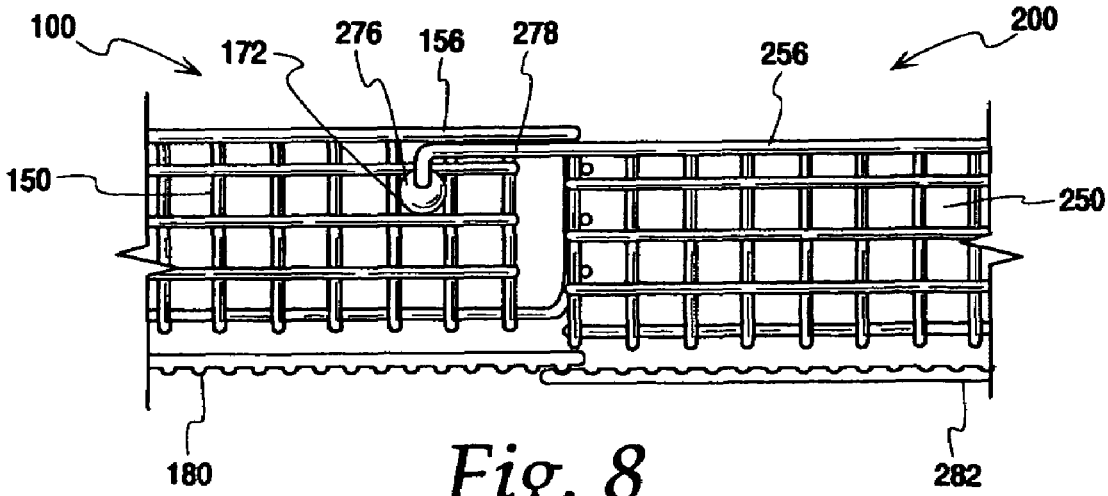
FIG. 8 is a drawing showing a side view of an alternate embodiment of the locking mechanism securing the base tray and first nesting tray of an assembled two tray expandable drawer organizer.
Figure 9:
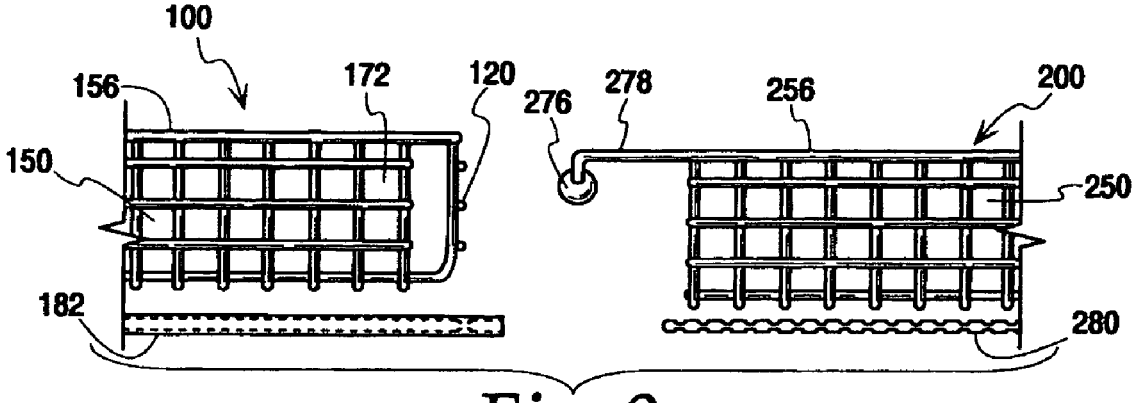
FIG. 9 is a drawing showing a side view of an alternate embodiment of a two tray expandable drawer organizer having an additional locking mechanism securing the base tray and first nesting tray, wherein a tube with a protrusion in the bore, attached to the base tray; is received by a rod with indentations, attached to the first nesting tray.
Figure 10:
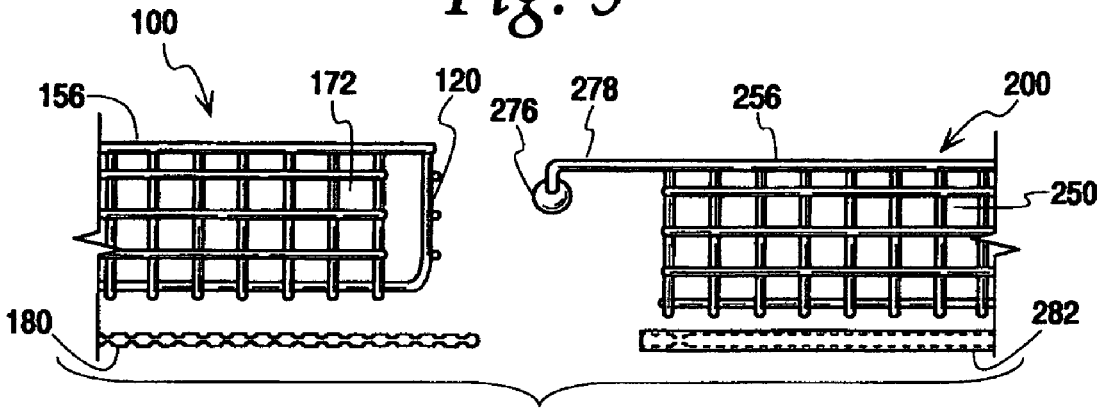
FIG. 10 is a drawing showing a side view of an alternate embodiment of a two tray expandable drawer organizer having an additional locking mechanism securing the base tray and first nesting tray, wherein a rod with indentations attached to the base tray; is received by a tube with a protrusion in the bore, attached to the first nesting tray.

Referring to FIGS. 8, 9 and 10 an alternate embodiment of a locking mechanism is generally shown at numbers 180, 182, 280 and 282 for a two tray organizer 10. FIGS. 8, 9 and 10 provide an exploded partial view of the alternate locking mechanism 180, 182, 280 and 282 wherein the base tray 100 and the first nesting tray 200 are engaged (FIG. 8) and disengaged (FIGS. 9 and 10).

Referring to FIG. 8 one embodiment of the locking mechanism is shown wherein the base tray 100 may have at least one male rod 180 of a given gauge and a given length; not in excess of the bottom panel front edge 116 (FIG. 3), attached to the bottom panel 110 (FIG. 3), in substantially parallel alignment to the bottom panel front edge 116 (FIG. 3) and bottom panel rear edge 118 (FIG. 3), the rod having a series of protrusions about the bottom surface The first nesting tray 200 may have at least one female rod 282, of a given gauge and length; having at least one indentation along the length of the topmost surface; not in excess of the front side panel bottom edge 248 (FIG. 3); attached to the bottom panel 210 (FIG. 3) in substantially parallel alignment to the front side panel bottom edge 248 (FIG. 3) and rear panel bottom edge 258 (FIG. 3), whereby the base tray 100 and male rod 180 are slidably engaged by said first nesting tray 200 and female rod 282, wherein the male rod 180 protrusion may be received by at least one indentation on the surface of the female rod 282, thereby maintaining the relative position of the base tray 100 and first nesting tray 200.

Referring to FIG. 9 one embodiment of the locking mechanism is shown wherein the base tray 100 may have at least one tube 182 of a given gauge and a given length; not in excess of the bottom panel front edge 116 (FIG. 3) attached to the bottom panel 110 (FIG. 3), in substantially parallel alignment to the bottom panel front edge 116 (FIG. 3) and bottom panel rear edge 118 (FIG. 3), the tube 182 having at least one protrusion within the bore. The first nesting tray 200 may have at least one rod 280 having a series of indentations, of a given gauge and length; not in excess of the front side panel bottom edge 248 (FIG. 3); attached to the bottom panel 210 (FIG. 3) in substantially parallel alignment to the front side panel bottom edge 248 (FIG. 3) and rear side panel bottom edge 258 (FIG. 3), that is received by tube 182, whereby the base tray 100 and tube 182 are slidably engaged by said first nesting tray 200 and rod 280, wherein at least one of the indentations may be engaged by the protrusion within the bore of tube 182, thereby maintaining the relative position of the base tray 100 and first nesting tray 200.

Referring to FIG. 10 one embodiment of the locking mechanism is shown wherein the base tray 100 may have at least one rod 180 of a given gauge and a given length; not in excess of the bottom panel front edge 116 (FIG. 3), attached to the bottom panel 110 (FIG. 3), in substantially parallel alignment to the bottom panel front edge 116 (FIG. 3) and bottom panel rear edge 118 (FIG. 3), the rod 180 having a series of indentations The first nesting tray 200 may have at least one tube 282, of a given gauge having at least one protrusion within the bore and length; not in excess of the front side panel bottom edge 248 (FIG. 3); attached to the bottom panel 210 (FIG. 3) in substantially parallel alignment to the front side panel bottom edge 248 (FIG. 3) and rear panel bottom edge 258 (FIG. 3), whereby the base tray 100 and rod are slidably engaged by said first nesting tray 200 and tube 282, wherein the rod 180 may be received by tube wherein at least one of the indentations may be engaged by the protrusion within the bore of the tube 282, thereby maintaining the relative position of the base tray 100 and first nesting tray 200.

Figure 11:
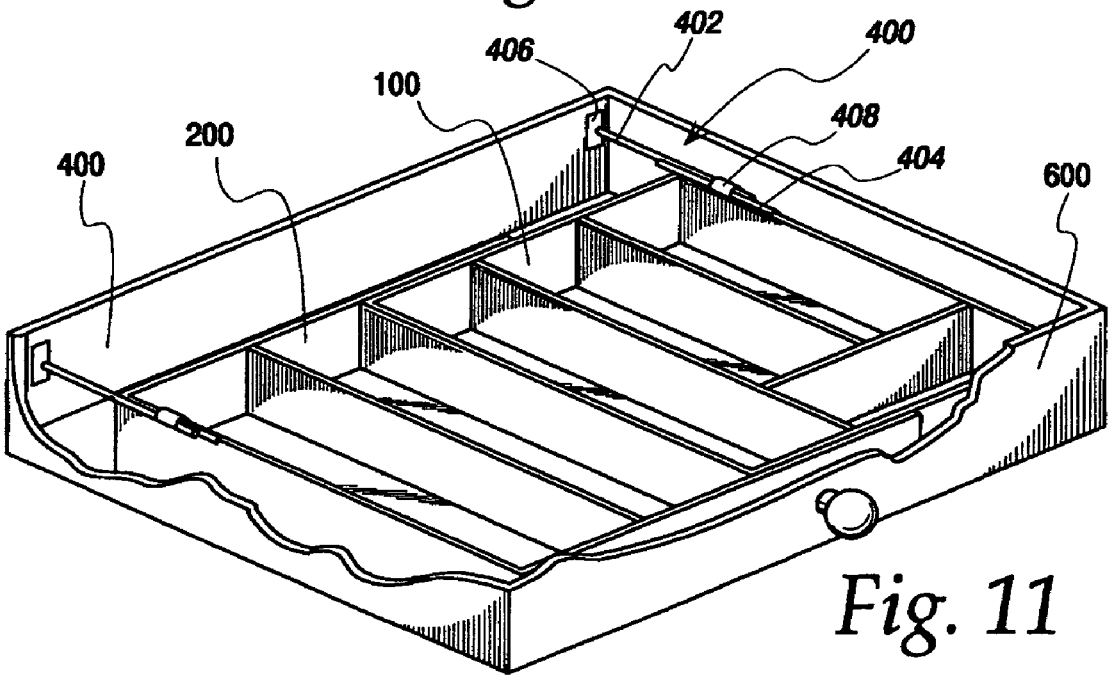
FIG. 11 is a drawing showing a perspective view of another embodiment of an assembled two tray expandable drawer organizer, secured with extendable retainers in a drawer.

Referring to FIG. 11 an extendable retainer mechanism is generally shown at number 400 for a three tray expandable organizer 10. FIG. 11 provides a perspective view of the three tray expandable organizer 10 with the extendable retainer mechanism 400 in place in a cutaway view of drawer 600. The extendable retainer mechanism 400 may comprise an extension arm 402 in slidable agreement with a friction stop/sleeve 404, which may be detachably connected to the rearmost proximity of the base tray 100 second side panel top edge 136 (FIG. 3) and the first nesting tray 200 first side panel top edge 226 (FIG. 3) by an extension arm connector 408 that clips over the respective panel edge. The extension arm 402 may have a given length and profile to provide for a channel to be formed about the longitudinal axis that permits the friction stop/sleeve 404 to ride therein. This channel may be tapered or reticulated to inhibit the movement of the friction stop/sleeve 404 about the channel length. The friction stop/sleeve 404 may be of a given length and of an opposing profile to the extension arm 402, such that the friction stop/sleeve 404 provides nominal alignment and moderate degree of friction, which is amplified upon assembly with the extension arm connector. This provides for the user to adjust the extendable retainer mechanism to achieve adequate tautness of the expandable organizer 10. The extension arm 402 and friction stop/sleeve 404 may be formed from wood, ferrous or non-ferrous materials adequate to provide substantial rigidity and required structural properties. The extension arm connector 408 may be shaped to tensionably retain an extension arm 402 in slidable communication with the friction stop/sleeve 404 thereby preventing the extension arm 402 from collapsing under load after being set to a predetermined length. The extension arm 402 may be fitted with a foot 406 at the distal end of the extension arm 402, wherein contact with the drawer 600 surface is maintained. The foot 402 may further comprise a flexible pad, to prevent marring or scratching the interior drawer 600 surface. The extendable retainer mechanism 400 serves to prevent the expandable drawer organizer 10 from shifting within a drawer 600 when subjected to impulse forces. In another embodiment the extendable retainer mechanism 400 may be configured from an expandable partition 500 (FIG. 7) designed to be attached to the base tray 100 second side panel top edge 136 (FIG. 3) and the first nesting tray 200 first side panel top edge 226 (FIG. 3) by an extension arm connector 408 that clips over the respective panel edge. Subsequently, this embodiment provides for the use of expandable partitions with the extendable retainer, thereby allowing the organization of the drawer to be optimized.

Figure 12:
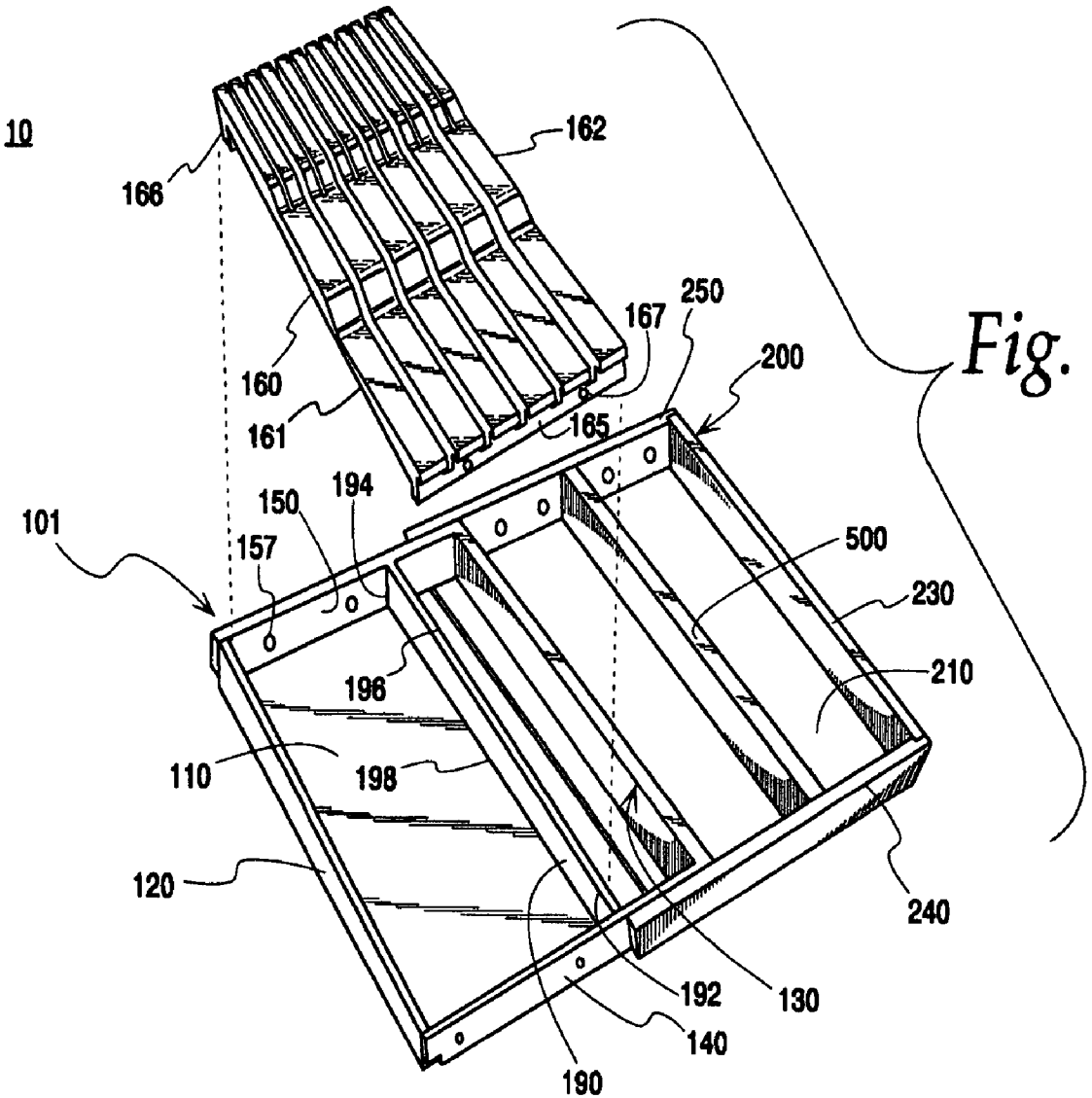
FIG. 12 is a drawing showing a perspective view of an embodiment of the expandable drawer organizer with a base tray having a knife block configuration, wherein the knife block topside is removed to reveal additional storage in the base tray, in accordance with the present invention.
Figure 13:
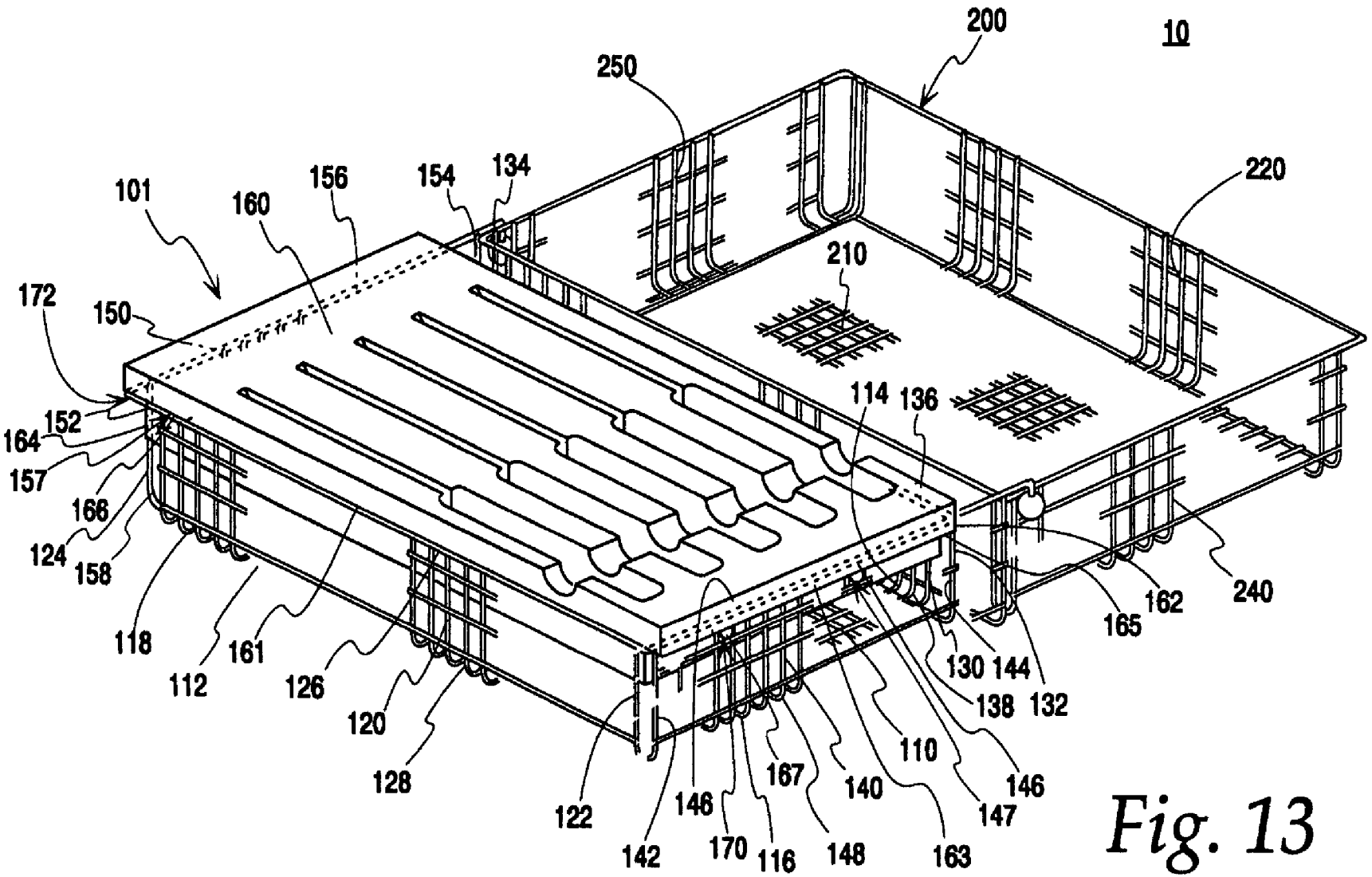
FIG. 13 is a drawing showing a perspective view of an embodiment of the first and second nesting tray having a knife block configuration, wherein the knife block topsides are removed to reveal additional storage in the base and first nesting tray, in accordance with the present invention.
Figure 14:
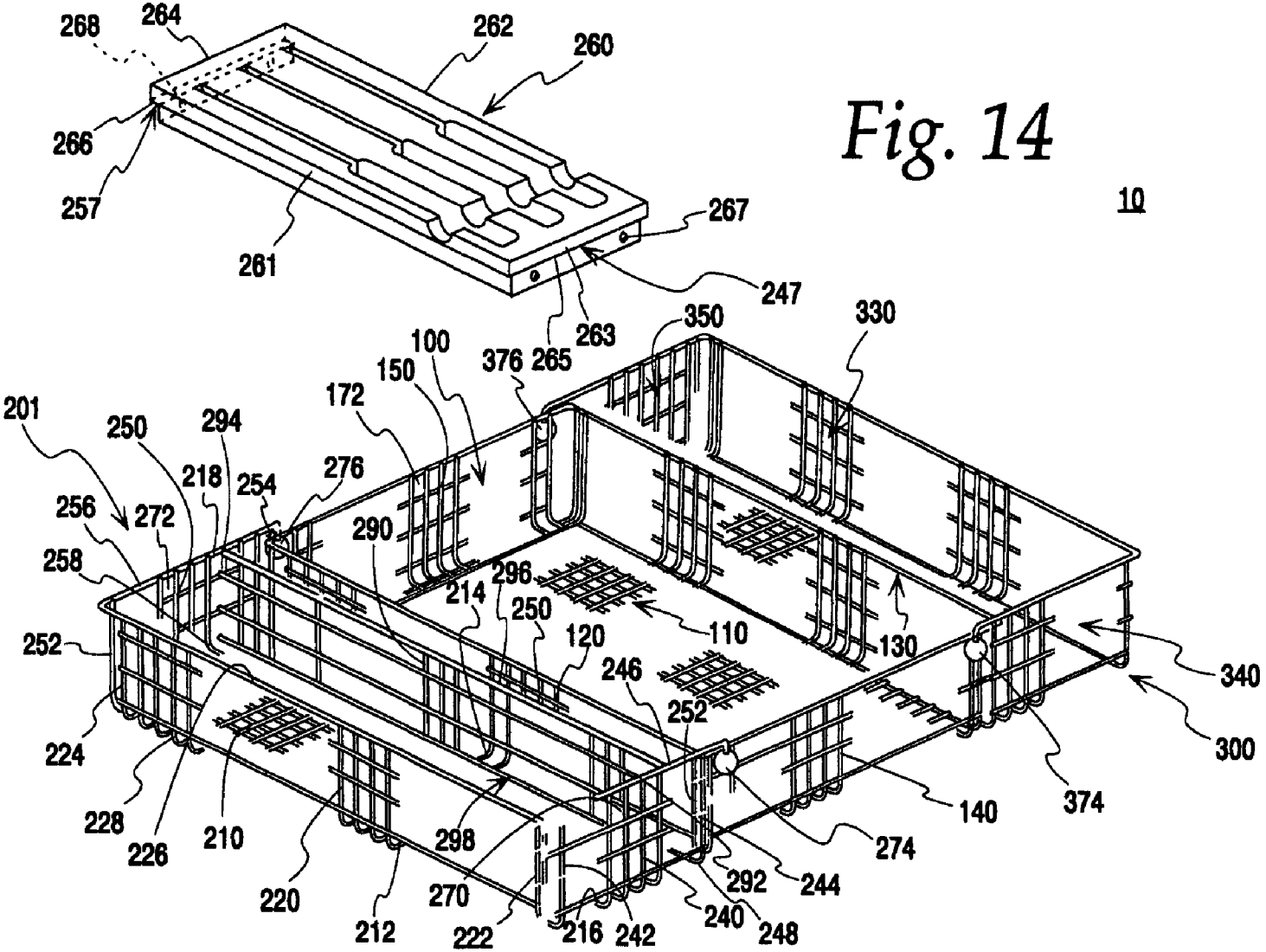
FIG. 14 is a drawing showing a top view of an embodiment of the expandable drawer organizer having a first and second nesting tray, wherein the base tray and first nesting tray demonstrate a configuration to accommodate an assortment of utensils, wherein the knife block is removed to reveal additional storage in the base tray, in accordance with the present invention.

Referring to FIGS. 12, 13 and 14 another embodiment of the base tray of the expandable drawer organizer 10 is generally shown at number 101 in shown in a two tray arrangement (FIG. 12, 13) and a three tray arrangement (FIG. 14).

Referring to FIG. 12 the base tray 101 may compromise a bottom panel 110 having a rectangular shape of a given length and width, a topside panel 160 having a rectangular shape of a given length and width and having a given profile about the plane of the topside panel 160 to accommodate the ordered arrangement of various utensils, a first side panel 120 having a rectangular shape of a given height and a length corresponding to the bottom panel 110, a second side panel 130 having a rectangular shape of a given height and substantially similar length to the first side panel 120, a front side panel 140 having a rectangular shape of a substantially similar height to each of the first side panel 120 and second side panel 130, and length corresponding to the bottom panel 110 width, and rear side panel 150 having a rectangular shape of a given height and substantially similar length to the front side panel 140. The first side panel 120 may be adjoined to the bottom panel 110 and topside panel 160 in a substantially perpendicular manner, wherein the bottom panel first edge 112 (FIG. 13) and the first side panel bottom edge 128 (FIG. 13) are maintained in continuous agreement over their length, and the topside panel first edge 161 (FIG. 13) and first side panel top edge 126 (FIG. 13) are maintained in continuous agreement over their length. The second side panel 130 may be adjoined to the bottom panel 110 and topside panel 160 in a substantially perpendicular manner, wherein the bottom panel second edge 114 (FIG. 13) and the second side panel bottom edge 138 (FIG. 13), and topside panel second edge 162 (FIG. 13) and second side panel top edge 136 (FIG. 13) are maintained in continuous agreement over their length, wherein the second side panel 130 may be in parallel alignment to the first side panel 120. The front side panel 140 may be adjoined to the bottom panel 110 and topside panel 160 in a substantially perpendicular manner, wherein the bottom panel front panel edge 116 (FIG. 13) and the front side panel bottom edge 148 (FIG. 13), and the topside panel front edge 163 (FIG. 13) and front side panel top edge 146 (FIG. 13) are maintained in continuous agreement over their length. The front side panel 140 may also be adjoined to each of the first side panel 120 and second side panel 130 in a substantially perpendicular manner, wherein the front side panel first edge 142 (FIG. 13) and front panel side second edge 144 (FIG. 13) are maintained in continuous agreement over their length with the respective first side panel front edge 122 (FIG. 13) and second side panel front edge 132 (FIG. 13). The rear side panel 150 may be adjoined to the bottom panel 110 in a substantially perpendicular manner, wherein the bottom panel rear edge 118 (FIG. 13) and the rear side panel bottom edge 158 (FIG. 13) are maintained in continuous agreement over their length. The rear side panel 150 may also be adjoined to each of the first side panel 120 and second side panel 130 in a substantially perpendicular manner, wherein the rear side panel first edge 152 (FIG. 13) and rear side panel second edge 154 (FIG. 13) are maintained in continuous agreement over their length with the respective first side panel rear edge 124 (FIG. 13) and second side panel rear edge 134 (FIG. 13). The rear side panel 150 being in substantially parallel alignment with the front side panel 140. The first side panel top edge 126 (FIG. 13), second side panel top edge 136 (FIG. 13), front side panel top edge 146 (FIG. 13) and rear side panel top edge 156 (FIG. 13) may exhibit congruency within a common plane. The base tray 101 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The base tray 101 may also be manufactured by such techniques as extrusion, cold forming methods i.e., bending, braking, shearing, cutting or hot forming methods i.e., casting or extrusion or combinations thereof that may yield similar construction. The front side panel 140 and rear side panel 150 of the base tray 101 of the present invention may respectively have at least one front side panel recess 170 (FIG. 14) and rear side panel recess 172 (FIG. 14) that may be arranged in a row in the face of each panel being of a given shape and depth to accommodate the respective first nesting tray 200 (FIG. 14) front side panel protuberance 274 (FIG. 14) and rear side panel protuberance 276 (FIG. 14) and in the case of the three tray expandable organizer 10 (FIG. 14) to accommodate the respective second nesting tray 300 (FIG. 14) front side panel protuberance 374 (FIG. 14) and rear side panel protuberance 376 (FIG. 14). In another embodiment of the base tray 101, the front side panel 140 and rear side panel 150 may respectively have at least one front side panel protuberance and rear side panel protuberance, that may be arranged in a row on the face of each panel being of a given shape and depth to accommodate the respective first nesting tray 200 (FIG. 14) and second nesting tray 300 (FIG. 14) front side panel recesses and rear side panel recesses. The base tray 101 may also have partitions 450 (FIG. 3) adjoined in normal position to the bottom panel 110 and at least one side of the base tray 101 to form compartments of a rectangular nature. In another embodiment, the expandable partitions 500 (FIG. 7) and fixed length partitions may be employed which may utilize a locking mechanism based upon the arrangement of protuberances and recesses similar to the arrangement utilized to secure the base tray 101, first nesting tray 200 and second nesting tray 300 at a predetermined length. In another embodiment the topside panel 160 (FIG. 13) may have a plurality of recesses of a given shape, to accommodate at least one utensil selected from a group of utensils consisting of forks, knives, spoons, spatulas, whisks, bottle openers, can openers, scissors, strainers, brushes, tongs, pot holders, handles, thermometers, skewers, presses, mallets, mashers, basting equipment and measuring utensils; located about a top side of said panel. The base tray 101 may also comprise hollow construction where upon removing the topside panel 160 additional storage may be revealed, which may be partitioned in any predetermined manner. The topside panel 160 may comprise at least one of either a topside panel front ridge 165 affixed to the topside panel front edge 163 (FIG. 13) and a topside panel rear ridge 166 affixed to the topside panel rear edge 164 (FIG. 13), which are respectively received by the base tray front side panel 140 and base tray rear side panel 150. In another embodiment the topside panel front ridge 165 and topside panel rear ridge 166 may have a topside panel front ridge protuberance 167 (FIG. 13) and topside panel rear ridge protuberance 168 (FIG. 13), respectively; which may be respectively received in a front side panel topside panel recess 147 and rear side panel topside panel recess 157, wherein they are maintained in positional agreement under constant force. In another embodiment the topside panel front ridge 165 and topside panel rear ridge 166 may have a topside panel front and rear ridge recess, which may receive a protuberance, located on the respective front side panel 140 and rear side panel 150. In another embodiment the topside panel 160 may be hingably attached to one of either the topside panel rear edge 164 and rear side panel 150; and topside panel front edge 163 and front side panel 140. Another embodiment contemplating hingably attaching the topside panel 160 to either or both of the topside panel first edge 161 (FIG. 13), topside panel second edge 162 (FIG. 13), and respective first side panel 120 and second side panel 130, wherein access to the storage area beneath the topside tray are accessed. In another embodiment the topside panel 160 may be comprised of at least two panels in horizontal slidable agreement wherein one of a slightly larger length than the corresponding panel may receive the corresponding panel. In another embodiment, the topside panel 160 may be comprised of at least two panels in vertical slidable agreement wherein one of a slightly larger width than the corresponding panel may receive the corresponding panel. In another embodiment the base tray 101 may comprise a topside panel partition 190 of a given length and width having a topside partition panel front edge 192, topside partition panel rear edge 194, topside partition panel top edge 196 and topside partition panel bottom edge 198 that may affixed to one of either the topside panel first edge 161 (FIG. 13) and topside panel second edge 162 (FIG.

13), and the bottom panel 110 in a normal plane, wherein topside partition panel 190 may be substituted for one of either the first side panel 120 and second side panel 130 in the structural configuration of the hollow base tray embodiment, which further permits a vacant section of the base tray 101 to exist adjacent to the topside panel partition 190.

Referring to FIG. 14 another embodiment of the first nesting tray of the expandable drawer organizer 10 is generally shown at number 201 in shown in a two tray arrangement (FIG. 12, 13) and a three tray arrangement (FIG. 14). The first nesting tray 201 may compromise a bottom panel 210 having a rectangular shape of a given length and width, a topside panel 260 having a rectangular shape of a given length and width and having a given profile about the plane of the topside panel 260 to accommodate the ordered arrangement of various utensils, a first side panel 220 having a rectangular shape of a given height and a length corresponding to the bottom panel 210, a topside partition panel 290 having a rectangular shape of a given height and substantially similar length to the first side panel 220, a front side panel 240 having a rectangular shape of a substantially similar height to each of the first side panel 220 and topside partition panel 290, and length corresponding to the bottom panel 210 width, and rear side panel 250 having a rectangular shape of a given height and substantially similar length to the front side panel 240. The first side panel 220 may be adjoined to the bottom panel 210 and topside panel 260 in a substantially perpendicular manner, wherein the bottom panel first edge 212 and the first side panel bottom edge 228 are maintained in continuous agreement over their length, and the topside panel first edge 261 and first side panel top edge 226 are maintained in continuous agreement over their length. The topside partition panel 290 may be adjoined to the bottom panel 210 and topside panel 260 in a substantially perpendicular manner, wherein the bottom panel second 210 and the topside partition panel bottom edge 298 are maintained in normal relationship, and topside panel second edge 262 and topside partition panel top edge 296 are maintained in continuous agreement over their length, wherein the topside partition panel 290 may be in parallel alignment to the first side panel 220. The front side panel 240 may be adjoined to the bottom panel 210 and topside panel 260 in a substantially perpendicular manner, wherein the bottom panel front panel edge 216 and the front side panel bottom edge 248, and the topside panel front edge 263 and front side panel top edge 246 are maintained in continuous agreement over their length. The front side panel 240 may also be adjoined to each of the first side panel 220 and topside partition panel 290 in a substantially perpendicular manner, wherein the front side panel first edge 242 and front panel side second edge 244 are maintained in continuous agreement over their length with the respective first side panel front edge 222 and topside partition panel front edge 292. The rear side panel 250 may be adjoined to the bottom panel 210 in a substantially perpendicular manner, wherein the bottom panel rear edge 218 and the rear side panel bottom edge 258 are maintained in continuous agreement over their length. The rear side panel 250 may also be adjoined to each of the first side panel 220 and topside partition panel 290 in a substantially perpendicular manner, wherein the rear side panel first edge 252 and rear side panel second edge 254 are maintained in continuous agreement over their length with the respective first side panel rear edge 224 and topside partition panel rear edge 294. The rear side panel 250 being in substantially parallel alignment with the front side panel 240. The first side panel top edge 226, topside partition panel top edge 296, front side panel top edge 246 and rear side panel top edge 256 may exhibit congruency within a common plane. The first nesting tray 201 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The first nesting tray 201 may also be manufactured by such techniques as extrusion, cold forming methods i.e., bending, braking, shearing, cutting or hot forming methods i.e., casting or extrusion or combinations thereof that may yield similar construction. The front side panel 240 and rear side panel 250 of the first nesting tray 201 of the present invention may respectively have at least one front side panel recess 270 and rear side panel recess 272 that may be arranged in a row in the face of each panel being of a given shape and depth to accommodate the respective base tray 100 front side panel protuberance 174 (FIG. 14) and rear side panel protuberance 176 (FIG. 14) and in the case of the three tray expandable organizer 10 (FIG. 14) may have a second nesting tray 300 (FIG. 14) having a front side panel recess 370 (FIG. 14) and rear side panel recess 372 (FIG. 14) that may respectively receive the base tray front and rear side panel protuberances, 174 (FIG. 14) and 176 (FIG. 14), respectively. In another embodiment of the first nesting tray 201, the front side panel 240 and rear side panel 250 may respectively have at least one front side panel protuberance and rear side panel protuberance, that may be arranged in a row on the face of each panel being of a given shape and depth to accommodate the respective base tray 100 (FIG. 14) front side panel recesses and rear side panel recesses. A similar embodiment is envisioned for the second nesting tray 300. The first nesting tray 201 may also have partitions 450 (FIG. 3) adjoined in normal position to the bottom panel 210 and at least one side of the first nesting tray 201 to form compartments of a rectangular nature. In another embodiment, the expandable partitions 500 (FIG. 7) and fixed length partitions may be employed which may utilize a locking mechanism based upon the arrangement of protuberances and recesses similar to the arrangement utilized to secure the base tray 100, first nesting tray 201 and second nesting tray 300 at a predetermined length. In another embodiment the topside panel 260 (FIG. 13) may have a plurality of recesses of a given shape, to accommodate at least one utensil selected from a group of utensils consisting of forks, knives, spoons, spatulas, whisks, bottle openers, can openers, scissors, strainers, brushes, tongs, pot holders, handles, thermometers, skewers, presses, mallets, mashers, basting equipment and measuring utensils; located about a top side of said panel. The first nesting tray 201 may also comprise hollow construction where upon removing the topside panel 260 addition storage may be revealed, which may be partitioned in any predetermined manner. The topside panel 260 may comprise at least one of either a topside panel front ridge 265 affixed to the topside panel front edge 263 and a topside panel rear ridge 266 affixed to the topside panel rear edge 264, which are respectively received by the first nesting tray front side panel 240 and first nesting tray rear side panel 250. In another embodiment the topside panel front ridge 265 and topside panel rear ridge 266 may have a topside panel front ridge protuberance 267 and topside panel rear ridge protuberance 267, respectively; which may be respectively received in a front side panel topside panel recess 247 and rear side panel topside panel recess 257, wherein they are maintained in positional agreement under constant force. In another embodiment the topside panel front ridge 265 and topside panel rear ridge 266 may have a topside panel front and rear ridge recess, which may receive a protuberance, located on the respective front side panel 240 and rear side panel 250. In another embodiment the topside panel 260 may be hingably attached to one of either the topside panel rear edge 264 and rear side panel 250; and topside panel front edge 261 and front side panel 240. Another embodiment contemplating hingably attaching the topside panel 260 to either or both of the topside panel first edge 261, topside panel second edge 262, and respective first side panel 220 and topside partition panel 290, wherein access to the storage area beneath the topside tray are accessed. In another embodiment the topside panel 260 may be comprised of at least two panels in horizontal slidable agreement wherein one of a slightly larger length than the corresponding panel may receive the corresponding panel. In another embodiment, the topside panel 260 may be comprised of at least two panels in vertical slidable agreement wherein one of a slightly larger width than the corresponding panel may receive the corresponding panel. In another embodiment the first nesting tray 201 may comprise a topside panel partition 290 of a given length and width having a topside partition panel front edge 292, topside partition panel rear edge 294, topside partition panel top edge 296 and topside partition panel bottom edge 298 that may affixed to one of either the topside panel first edge 261 and topside panel second edge 262, and the bottom panel 210 in a normal plane, wherein topside partition panel 290 may be substituted for the first side panel 220 in the structural configuration of the hollow first nesting tray embodiment, which further permits a vacant section of the first nesting tray 201 to exist adjacent to the topside panel partition 290.

Referring to FIG. 14 one embodiment of a three tray arrangement of an expandable drawer organizer is generally shown at number 10. The expandable drawer organizer 10 may comprise a base tray 101, a first nesting tray 201 and a second nesting tray 300. In another embodiment the expandable drawer organizer 10 may have a second nesting tray 300 that may be a substantial mirror image of the second nesting tray 201, and further anticipate all the various embodiments of the second nesting tray 201, previously set forth. In another embodiment of the expandable drawer organizer 10, a knife block that may comprise a box having a topside, bottom side, first side, second side, front side and rear side; being of either hollow or solid construction, wherein the topside of the block is configured to retain various utensils in an ordered fashion, and at least one of either the bottom side, front side, rear side, first side and second side may have protuberances to allow it to be tensionably positioned in a predetermined location in the base tray, first or second nesting tray. In another embodiment the topside of the knife block may be detachably attached, wherein upon the removal of the topside in the hollow version additional storage may be found, whereas the solid version a solid surface for cutting or other culinary operations may be performed.

Figures 15, 16:
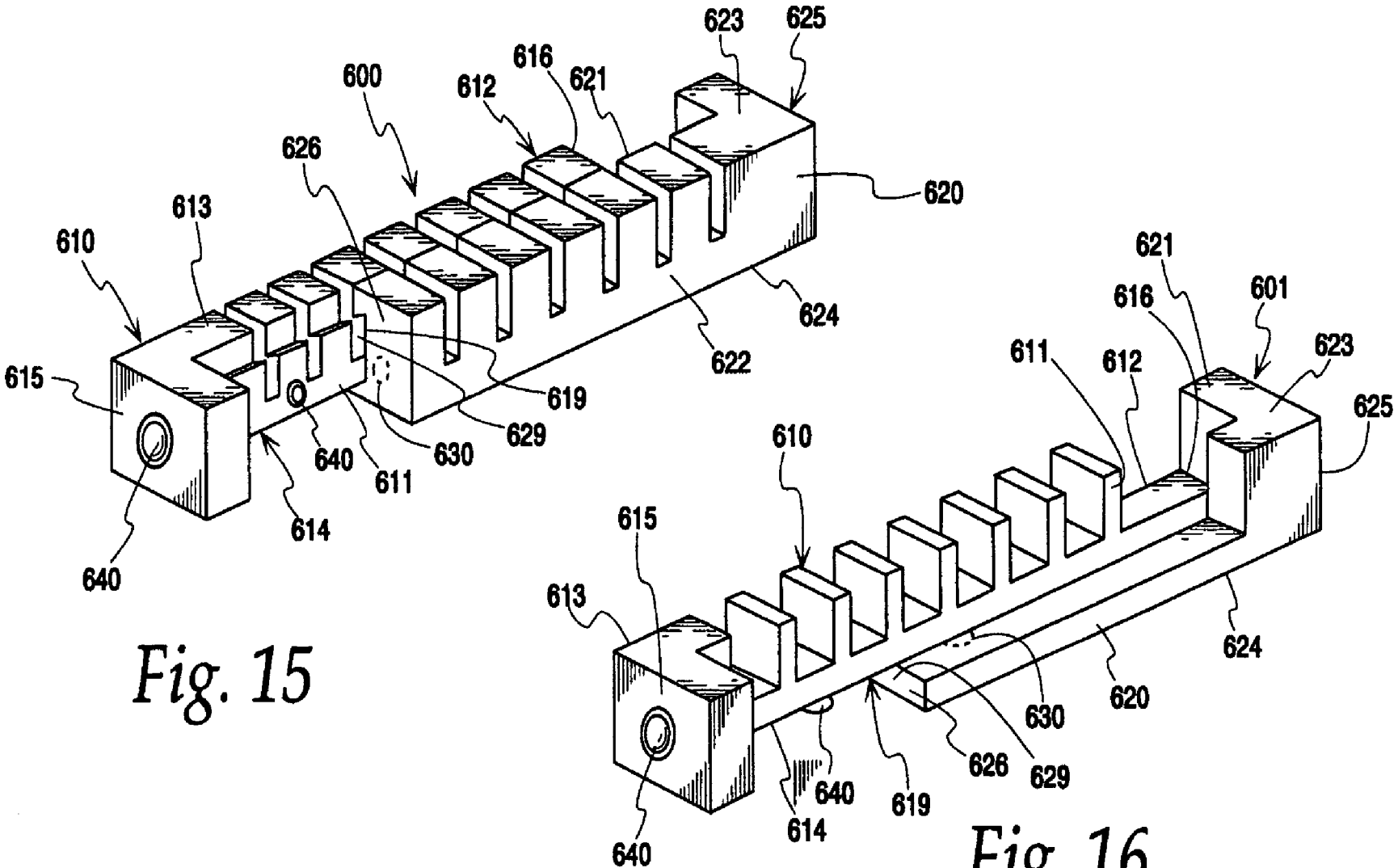
FIG. 15 is an assembly drawing showing a perspective view of an embodiment of the expandable partition having a configuration to retain cutlery, in accordance with the present invention.
FIG. 16 is an assembly drawing showing a perspective view of another embodiment of the expandable partition having a configuration to retain cutlery, wherein the given length of the expandable partition is fixed and an extendable retaining arm is shown, in accordance with the present invention.
Figure 17:
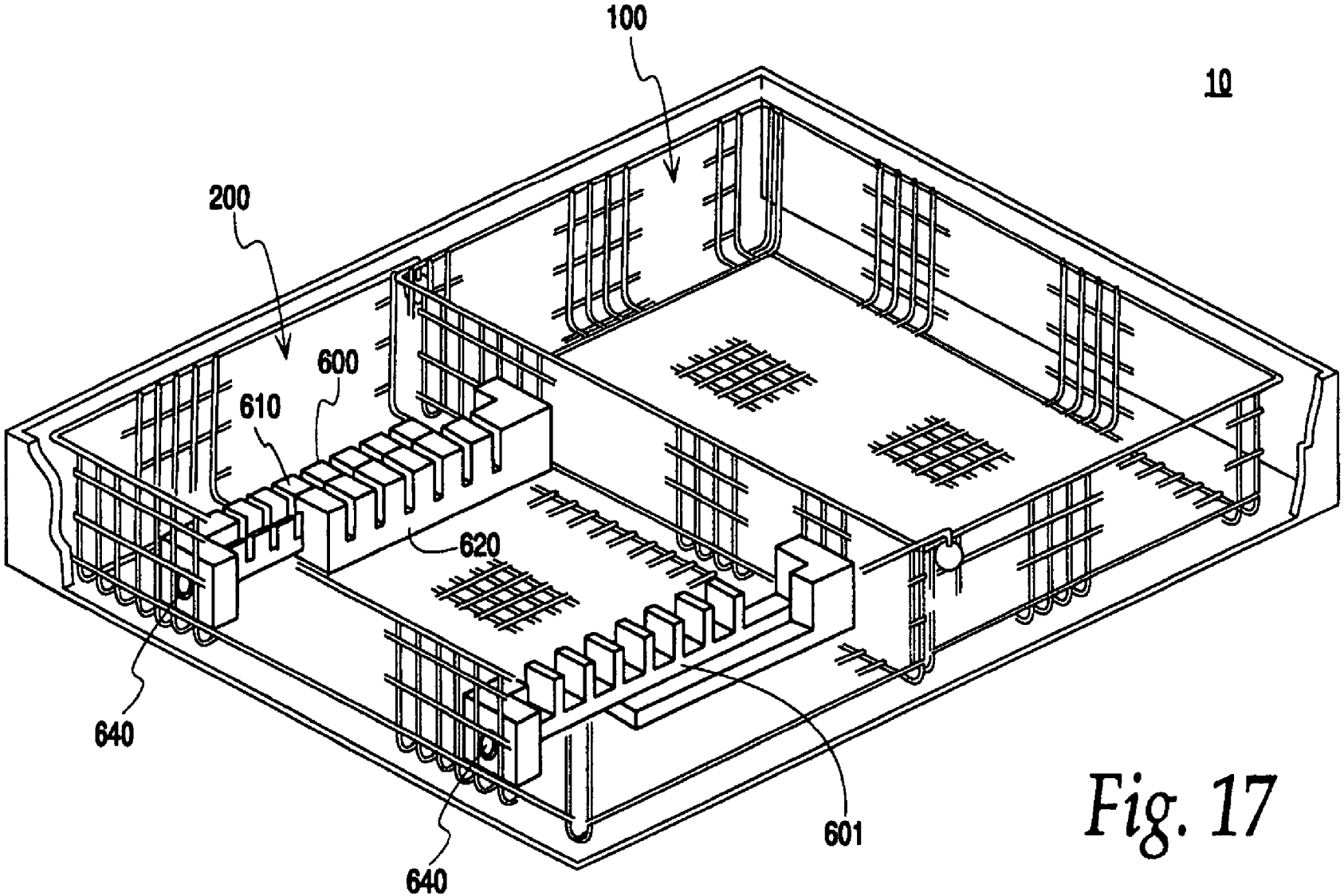
FIG. 17 is a drawing showing a perspective view of both embodiments of the expandable partition installed in an expandable drawer organizer having a first and second nesting tray, wherein the expandable retainers demonstrate a configuration to accommodate an assortment of cutlery are located in the base tray and first nesting tray, in accordance with the present invention.

Referring to FIGS. 15, 16 and 17, embodiments of an expandable partition are generally shown at 600 and 601. The expandable partition 600 may comprise a first slidable element 610 of a given length and width, having a first side 611 and a second side 612, a top side 613, a bottom side 614, a first edge 615, a second edge 616; a second slidable element 620, of a given length and width, having a first side 621, a second side 622, a top side 623, a bottom side 624, a first edge 625, a second edge 626. The first slidable element 610 may further comprise at least one rail 619 or any similar such profile located on one of either of the first side 611 and second side 612, which may be received in a corresponding groove 629 located in one of either the first side 621 and second side 622 of the second slidable element 620, whereby a user can adjust the length of the expandable partition 600 to a desired length. An integral locking mechanism whereby, the first and second slidable elements 610 and 620, respectively may be tensionably maintained in a predetermined configuration by a protuberance 640 located on the profile 619 and received by a recess 630 located in the groove 629. In another embodiment, the protuberance 640 is located in the groove 629 and received by a recess 630 located in the profile 619. The first and second slidable element top sides, 613 and 623, respectively may have a plurality of recesses of a given shape, to accommodate at least one utensil selected from a group of utensils consisting of forks, knives, spoons, spatulas, whisks, bottle openers, can openers, scissors, strainers, brushes, tongs, pot holders, handles, thermometers, skewers, presses, mallets, mashers, basting equipment and measuring utensils; wherein the alignment of these recesses may be through sliding each element to achieve alignment. The first slidable element first end 615 and second end 616; and the second slidable element first end 625 and second end 626, wherein the aforementioned first and second slidable element ends are opposing ends, may further comprise a protuberance 640 on each opposing end that may be received in a recess in a normal position located within the expandable drawer organizer 10 (FIG. 17) base tray 100, first nesting tray 200 and second nesting tray 300 as determined by the user. In another embodiment the expandable partition 600 may have recesses 630 located on the opposing ends that are engaged by protuberances located in expandable drawer organizer 10 base tray 100, first nesting tray 200 and second nesting tray 300 as determined by the user. The expandable partition 600 may be constructed of wood, metal, plastic or any combination thereof that provide suitable structural properties to accommodate the aforementioned construction and provide the desired rigidity. The method of adjoining each of the aforementioned sides may be by any means know in the Mechanical Arts such as welding, soldering, brazing, the use of fasteners, rivets, screws, nails, or the use of adhesives. The expandable partition 600 may also be manufactured by such techniques as extrusion, cold forming methods i.e., bending, braking, shearing, cutting or hot forming methods i.e., casting or extrusion or combinations thereof that may yield similar construction. An alternate embodiment is generally shown at 601 (FIG. 16) wherein a distinction is made between the first slidable element 610 which may comprise a plurality of recesses of a given shape, to accommodate at least one utensil selected from a group of utensils consisting of forks, knives, spoons, spatulas, whisks, bottle openers, can openers, scissors, strainers, brushes, tongs, pot holders, handles, thermometers, skewers, presses, mallets, mashers, basting equipment and measuring utensils, which is slidably engaged with a second slidable element 620 that serves to maintain the positional alignment of the first slidable element 610 with the expandable drawer organizer 10 (FIG. 17) without regard to registration of the topside configuration to accommodate utensils.

Figure 18:
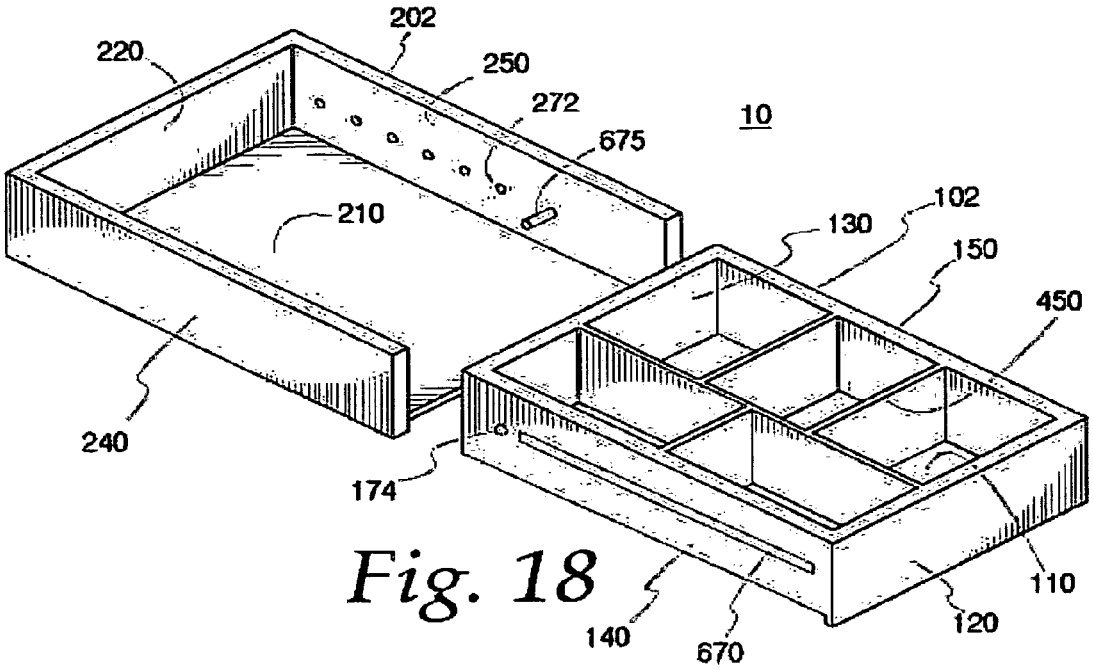
FIG. 18 is a drawing showing a perspective view of an embodiment of the expandable drawer organizer wherein a guide pin in the first nesting tray is received in a slot in the base tray, in accordance with the present invention.
Figure 19:
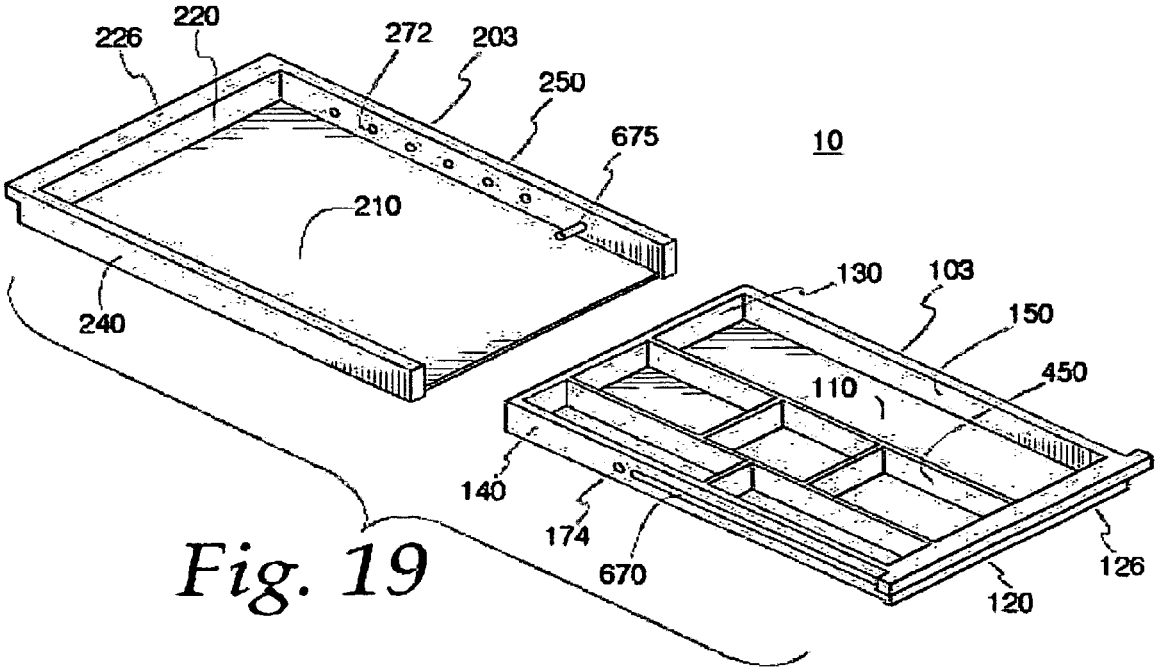
FIG. 19 is a drawing showing a perspective view of an embodiment of the expandable drawer organizer wherein a guide pin in the first nesting tray is received in a slot in the base tray and the side edges of the base tray and first nesting tray rest upon the drawer sides, in accordance with the present invention.
Figure 20:
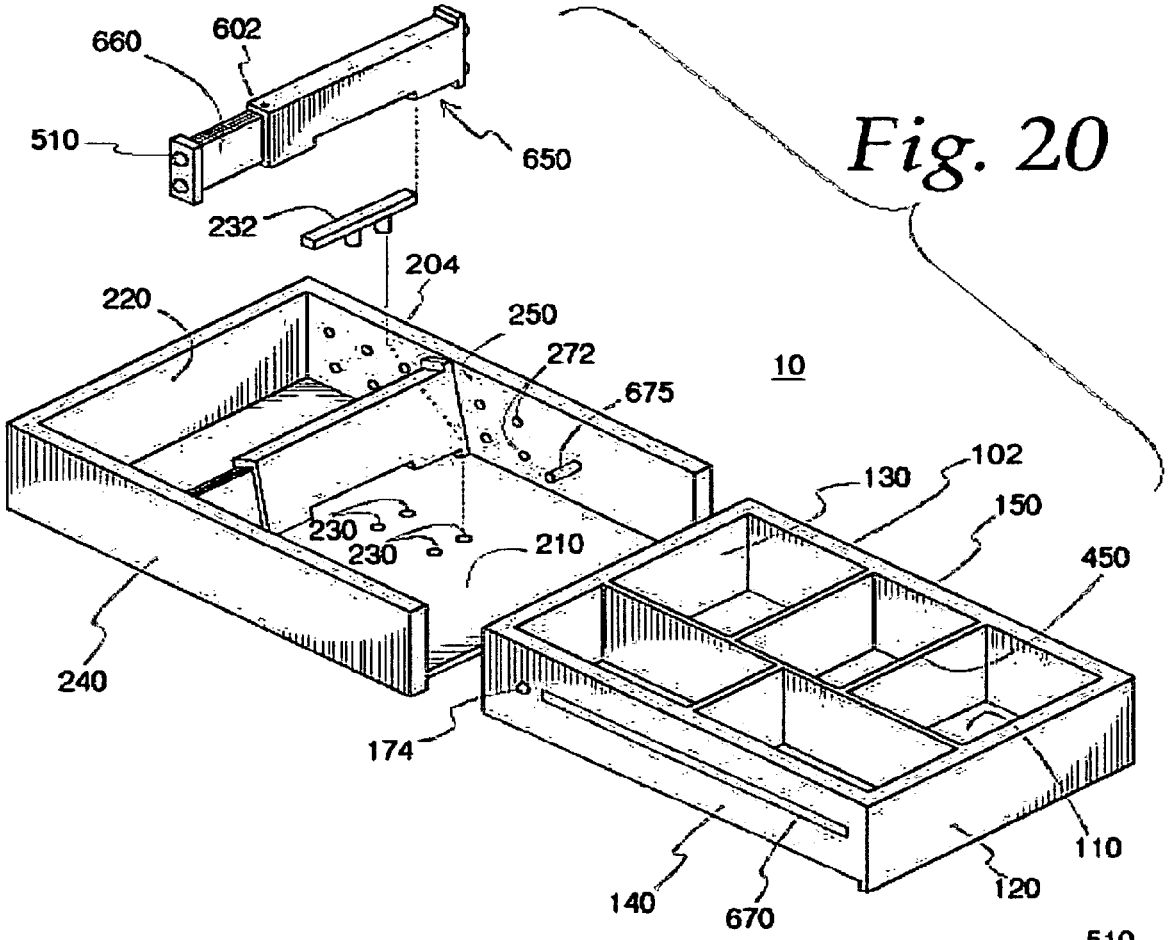
FIG. 20 is a drawing showing a perspective view of an embodiment of the expandable drawer organizer wherein a guide pin in the first nesting tray is received in a slot in the base tray, and the first nesting tray has a series of recesses to provide for an expandable partition to serve as an angled row insert with a base support cleat, in accordance with the present invention.

Referring to FIGS. 18, 19 and 20, other embodiments of the base tray and first nesting tray of the expandable drawer organizer 10 are generally shown at numbers 102 and 202 (FIG. 18), numbers 103 and 203 (FIG. 19), and numbers 102 and 204 (FIG. 20), in various two tray arrangements (FIG. 18, 19 and 20).

Referring to FIG. 18 an embodiment of the expandable drawer organizer is generally shown at number 10. The expandable drawer organizer 10 as represented in the present embodiment comprises a channeled base tray 102 and a first nesting tray 202. The channeled base tray 102 and the first nesting tray 202 further comprising substantially similar construction to base tray 100 (FIG. 1) and first nesting tray 200 (FIG. 2), respectively; with the addition of a channel 670 being incorporated into an external surface of at least one of either the front side panel 140 and rear side panel 150; wherein the channel 670 may be engaged by a stud 675 located in the internal surface of a corresponding first nesting tray 202 front side panel 240 and rear side panel 250. The channel 670 may comprise an elongated slot of a predetermined length that may have an internal cross-sectional shape selected from a group consisting of the letters C, E, I, M, N, S, U, V, W and Z. The stud 675 may be of a given size and have a shape that directly correlates with the channel 670 cross-sectional shape, so as to provide slidable agreement throughout the length of the channel 670. In another embodiment the channel 670 may be incorporated into at least one of either the internal front side 240 and rear side 250 wall of the first nesting tray 202 and the corresponding side of the base tray 102 further comprising a stud 675, which is in slidable agreement with the channel 670. The stud 675 may comprise any material of construction such as wood, metal, plastic, stone or any other non-deformable material known in the Mechanical Arts that is suitable for directing a tray possessing a channel about a given length. The stud 675 may be attached by any such means as welding, soldering, brazing, ultrasonic welding, adhesive bonding, riveting, screwing, bolting, friction-pressure fitting techniques, nailing or any other acceptable means known in the Mechanical Arts that are acceptable given the materials of construction of the expandable drawer organizer 10. The stud 675 may be received in the channel 670 wherein additional stability for the expandable drawer organizer 10 is realized throughout the range of operation. When this feature is taken together with the locking mechanism 50 (FIG. 4-6) the expandable drawer organizer 10 presents the user with additional rigidity and precision of operation. This aspect becomes more apparent to a user when the expandable organizer 10 is extended to the approximate limits of its length. The channel 670 and stud 675 serve to provide a means of cross-lateral stabilization and may additionally serve to prevent the unwanted disengagement of the base tray 102 and first nesting tray 202 upon expansion to the limit of the expandable drawer organizer 10. In another embodiment the expandable drawer organizer 10 may comprise a second nesting tray further comprising a stud 675 located in at least one of either the internal surface of the second nesting tray front side panel 340 and rear side panel 350, which may be in slidable agreement with the channel 670 of the base tray 102. In another embodiment the expandable drawer organizer 10 may comprise a second nesting tray further comprising a channel 670 located in at least one of either the internal surface of the second nesting tray front side panel 340 and rear side panel 350, which may be in slidable agreement with the stud 675 of the base tray 102.

Referring to FIG. 19 an embodiment of the expandable drawer organizer is generally shown at number 10. The expandable drawer organizer 10 as represented in the present embodiment comprises a ledged base tray 103 and a ledged first nesting tray 203. The ledged base tray 103 and the ledged first nesting tray 203 further comprising substantially similar construction to base tray 102 (FIG. 18) and first nesting tray 202 (FIG. 18), respectively; with the addition of a widened ledge located about the base tray 103 first side panel edge 126 and the first nesting tray 203 first side panel edge 226. The substantially widened ledge provides for the expandable drawer organizer 10 to securely rest upon the topmost edge of a drawer side, where it may be slid to the front or rear of the drawer to reveal other items stored below the expandable drawer organizer 10. The respective first side panel edges 126 and 226 may further comprise a contact surface of a given shape, wherein the incorporation of a durable non-abrasive material into the underside of the ledge is contemplated in at least one location, which is in direct contact with drawer topmost edge. This contact surface may be selected from a group of anti-friction materials consisting of TEFLON®, melamine, plastic, polished marble, felt and polished metal. In another embodiment, one or more casters may be incorporated in at least one location about the length of the ledges of the respective first side panel edges 126 and 226, to permit the expandable drawer organizer 10 to roll about the topmost edge of the drawer. In another embodiment of the expandable drawer organizer 10, a second nesting tray bearing substantially similar construction to the first nesting tray 203 is envisioned, wherein it is located opposite the first nesting tray 203 and in slidable agreement with the base tray 102.

Figure 22:
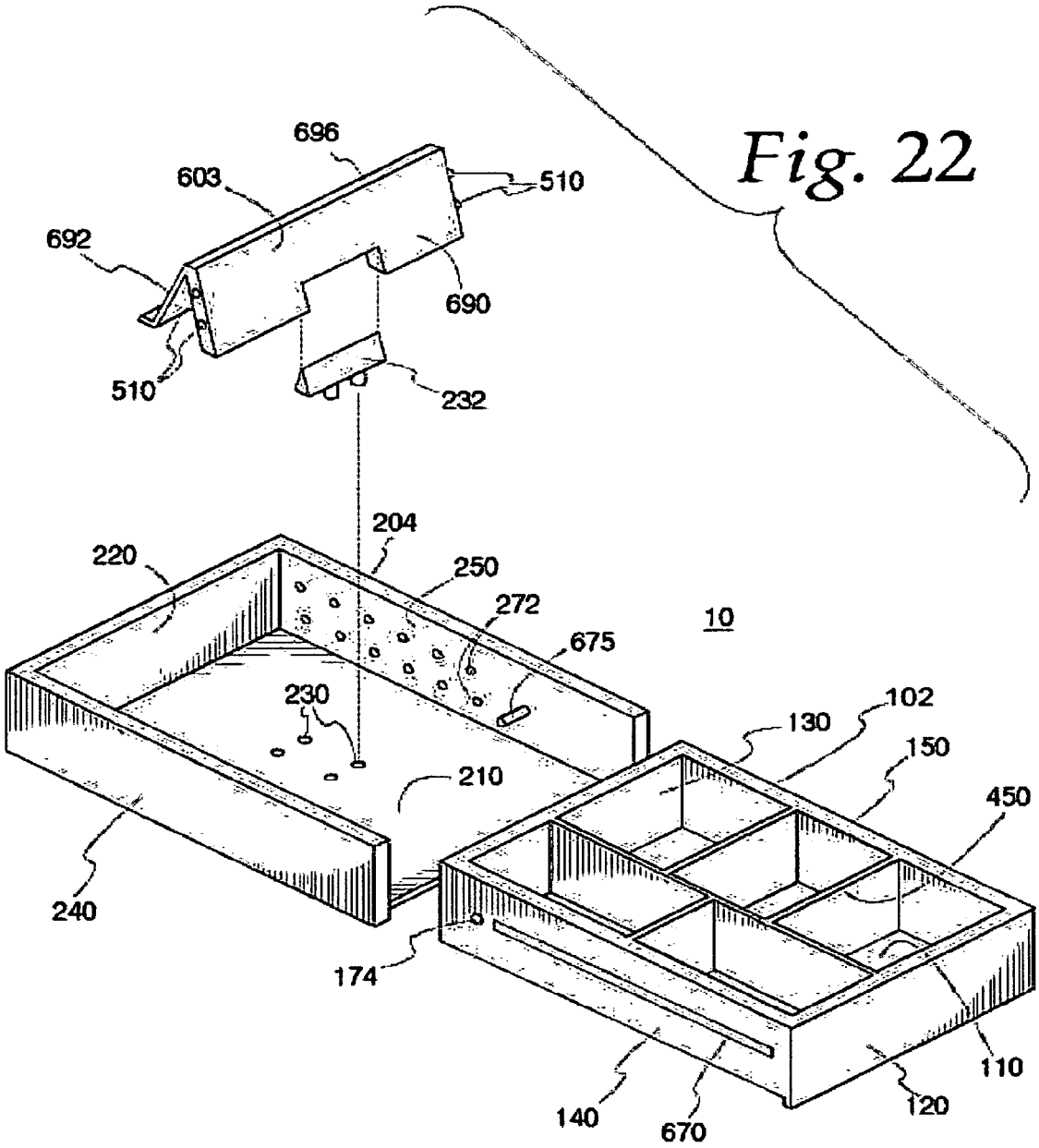
FIG. 22 is a drawing showing a perspective view of an embodiment of the expandable drawer organizer wherein a guide pin in the first nesting tray is received in a slot in the base tray, and the first nesting tray has a series of recesses to accommodate mounting an angular row insert and a cleat, in accordance with the present invention.

Referring to FIGS. 20 and 22 an embodiment of the expandable drawer organizer is generally shown at number 10. The expandable drawer organizer 10 as represented in the present embodiment comprises a channeled base tray 102 and a first nesting tray 204. The channeled base tray 102 (FIG. 18) as previously described and the first nesting tray 204, further comprising substantially similar construction to first nesting tray 202 (FIG. 18), with the addition of at least one cleat recess 230 located in the first nesting tray 204 bottom panel 210 in a location that affords a cleat 232, which may further comprise a given shape that coincides with one of either an auto-adjusting expandable partition 602 (FIG. 20) or an angular partition 603 (FIG. 22), to be received into the cleat recess 232. The first nesting tray 204 may further comprise additional front side panel recesses 270 and rear side panel recesses 272, which may be further arranged in a parallel row with interposing recesses that will afford the auto-adjusting expandable partition to be mounted in an angular or perpendicular fashion. In another embodiment the base tray 102 may have at least one row of recesses located in the interior walls of front side panel 140 and rear side panel 150, to accommodate the mounting of either an auto-adjusting expandable partition 602 (FIG. 20) or an angular partition 603 (FIG. 22). The angular partition 603 (FIG. 22) may comprise a front side 690, a rear side 696 with an attached foot 692 and protuberances 510 located about the edges of the front side 690 that correspond to recesses 270 and 272 located in the first nesting tray 204. In another embodiment, the front side 690 may have a recess provided to accommodate a cleat 232. In another embodiment of the expandable drawer organizer 10, at least one of either the base tray 102 and the first nesting tray 202 (FIG. 18) may have at least one angular shelf permanently mounted therein. The angular shelf may be comprised of similar materials of construction as the expandable drawer organizer 10 and may be affixed by any such means as welding, soldering, brazing, ultrasonic welding, adhesive bonding, riveting, screwing, bolting, friction-pressure fitting techniques, nailing or any other acceptable means known in the Mechanical Arts that are acceptable given the materials of construction of the expandable drawer organizer 10. The configuration of the angular shelf may comprise a variety of shapes to accommodate specific containers and accommodate individually packaged items to permit optimization of their storage. In a variant of this embodiment the partition may comprise a panel of a given length having a plurality of slots or recesses to receive a slotted non-expandable divider of a given length and configuration or another expandable divider oriented such that slotted elements are in agreement which may normally engage adjacent partitions, panels or the sides of the drawer directly.

Figure 21:
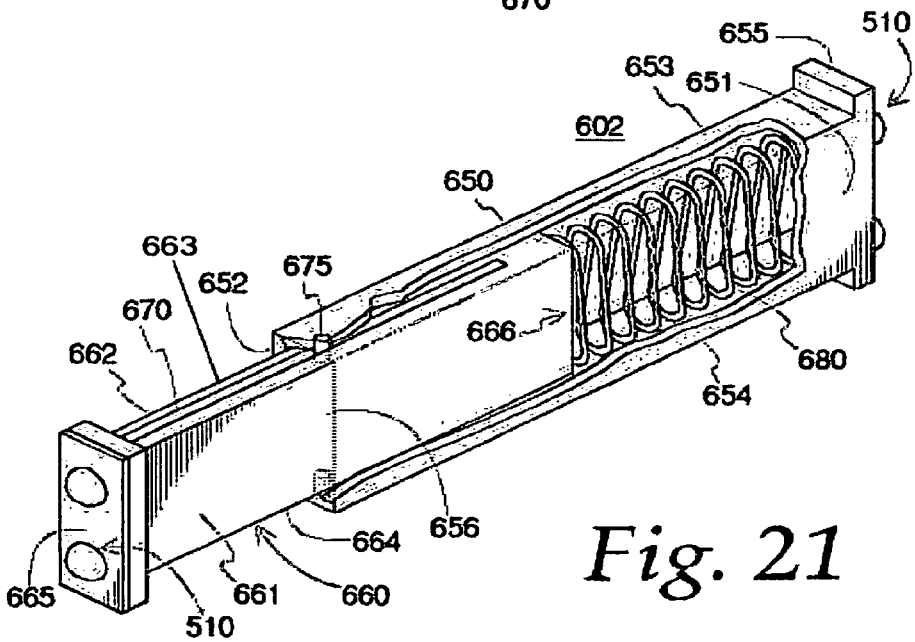
FIG. 21 is drawing showing a perspective view of another embodiment of the expandable partition wherein a spring-loaded tensioning element is employed in conjunction with protuberances found at the first and second contact surfaces corresponding to recesses in the expandable drawer organizer, in accordance with the present invention.

Referring to FIG. 21 an embodiment of an auto-adjusting expandable partition is generally shown at 602. The auto-adjusting expandable partition 602 may comprise a receptacle 650 further comprising a housing of a given length, height and width, having a first side 651 and a second side 652, a top side 653, a bottom side 654, a first edge 655, a second edge 656; an extension element 660 further comprising a housing of a given length, height and width, having a first side 661, a second side 662, a top side 663, a bottom side 664, a first edge 665, a second edge 666 and a spring 680. The receptacle 650 forms a hollow housing of a given size and shape that is slightly larger than the external shape of the extension element 660 whereby the extension element 660 also comprising hollow construction may receive a formed spring 680 whereby the spring may exert a tensionable force upon the receptacle 650 and the extension element 660. The force exerted by the spring 680 serves to drive the receptacle 650 and the extension element 660 in opposite directions and allows the auto-adjusting expandable partition 602 to maintain it position within the expandable drawer organizer 10 or a drawer. The receptacle 650 may further comprise at least one stud 675 or any similar such profile located on one of either of the top side 653 and bottom side 654, which may be received in a corresponding channel 670 located in one of either the top side 663 and bottom side 664 of the extension element 660, whereby a user can position the auto-adjusting expandable partition 602 and allow it to expand to a length dictated by the dimensional limitations of drawer or other such space. Another embodiment employs at least one protuberance 510 located on the second edges 655 and 665 of the receptacle 650 and the extension element 660, which correspond to a group of recesses selected from 270 and 272; 370 and 372 (FIG. 3); and recesses located in the interior walls of front side panel 140 and rear side panel 150. In another embodiment the protuberance 510 may be maintained at constant force via spring loading. In another embodiment, the expandable partition may comprise a variety of shapes to accommodate specific containers and accommodate individually packaged items to permit optimization of their storage. In a variant of this embodiment the partition may comprise a panel of a given length having a plurality of slots or recesses to receive a slotted non-expandable divider of a given length and configuration or another expandable divider oriented such that slotted elements are in agreement which may normally engage adjacent partitions, panels or the sides of the drawer directly. This aspect directly overcomes the previous need for a customized drawer tray configuration, while simultaneously maintaining the desired interchangeability of the organizer between drawers of differing dimensional constraints.

While the embodiments of the present invention disclosed herein are presently considered to be preferred, various changes and modifications can be made without departing from the spirit and scope of the present invention. The scope of the present invention is indicated in the appended claims, and all changes that come within the meaning and range of equivalents are intended to be embraced therein.

What is claimed is:

1. An expandable drawer organizer for segregating articles within a drawer comprising:

a base tray having a bottom panel, a front side panel, a rear side panel, a first side panel and a second side panel; each having a top side, a bottom side, a first end, a second end, a first side and a second side wherein, the front side panel, rear side panel, first side panel and second side panel are affixed to the respective edges of the bottom panel in a substantially perpendicular fashion, wherein the front side panel and rear side panel are in substantially parallel alignment and adjoined to the first side panel and second side panel in a substantially perpendicular manner, the first side panel and second side panel which are in substantially parallel alignment, whereby a rectangular tray is formed having an inside and outside surface, a first nesting tray having a bottom panel having a width slightly greater than the base tray, that will permit the base tray to be slidably received in spaced relationship, a front side panel, a rear side panel, and a first side panel; each having a top side, a bottom side, a first end, a second end, a first side and a second side wherein, the front side panel, rear side panel, and first side panel are affixed to the respective edges of the bottom panel in a substantially perpendicular fashion, wherein the front side panel and rear side panel are in substantially parallel alignment and adjoined to the first side panel in a substantially perpendicular manner, wherein the base tray is received by the first nesting tray, at least one channel having a given length, depth and shape located on the outside of at least one of either the base tray and nesting tray, at least one stud having a given shape and size located on the inside of one of either the first nesting tray front side panel and first nesting tray rear side panel, so as to correspond with the adjacent channel of the base tray in slidable agreement, wherein the base tray and first nesting tray are maintained in at least one predetermined position, at least one partition affixed to one of either of the front side panel, rear side panel, first side panel and second side panel of the base tray in substantially perpendicular alignment to the adjoining side panel and the bottom panel, for segregating articles within the base tray, and further comprising at least one angular partition with a cleat recess located in one of either the base tray and first nesting tray, the angular partition with the cleat recess further comprising hollow construction that provides for the partition with the cleat recess to be detachably mounted in one of either the base tray and first nesting tray by utilizing at least one protuberance under tensionable force that is received in a corresponding recess in one of either the base tray and first nesting tray and a cleat received in the cleat recess of the angular partition.

* * * * *